US010287136B2

(12) United States Patent
Bergem

(10) Patent No.: US 10,287,136 B2
(45) Date of Patent: May 14, 2019

(54) HEAVE COMPENSATOR AND METHOD FOR REDUCING THE RISK OF SNAP-LOADS DURING THE SPLASH-ZONE PHASE

(71) Applicant: Ernst-B. Johansen AS, Stathelle (NO)

(72) Inventor: Oddbjørn Bergem, Sandefjord (NO)

(73) Assignee: Ernst-B. Johansen AS, Stathelle (NO)

( * ) Notice: Subject to any disclaimer, the term of this patent is extended or adjusted under 35 U.S.C. 154(b) by 0 days.

(21) Appl. No.: 15/647,753

(22) Filed: Jul. 12, 2017

(65) Prior Publication Data

US 2018/0016120 A1 Jan. 18, 2018

(30) Foreign Application Priority Data

Jul. 12, 2016 (EP) ..... 16179022

(51) Int. Cl.

| | |
|---|---|
| ***E21B 19/00*** | (2006.01) |
| ***E21B 19/09*** | (2006.01) |
| ***B66C 13/04*** | (2006.01) |
| ***B66C 23/52*** | (2006.01) |
| ***B66D 1/52*** | (2006.01) |
| ***B66C 13/02*** | (2006.01) |

(52) U.S. Cl.

CPC ..... *B66C 13/04* (2013.01); *B66C 13/02* (2013.01); *B66C 23/52* (2013.01); *B66D 1/52* (2013.01)

(58) Field of Classification Search

CPC ..... E21B 19/006; E21B 19/09; B66D 1/52; B66C 13/02; B66C 13/04; B66C 23/52

See application file for complete search history.

(56) References Cited

U.S. PATENT DOCUMENTS

| | | | | |
|---|---|---|---|---|
| 3,842,603 | A | 10/1974 | Ditzen | |
| 3,912,227 | A * | 10/1975 | Meeker | E21B 19/09 175/5 |
| 4,175,342 | A | 11/1979 | de Koning et al. | |
| 4,724,970 | A * | 2/1988 | Kuhn | B66C 13/02 212/272 |
| 7,329,070 | B1 * | 2/2008 | Trent | E21B 19/006 405/224.4 |
| 7,934,561 | B2 | 5/2011 | Ormond | |
| 9,359,836 | B2 * | 6/2016 | Liland | E21B 19/09 |
| 9,359,837 | B2 * | 6/2016 | Poehner | E21B 19/002 |

(Continued)

FOREIGN PATENT DOCUMENTS

| | | |
|---|---|---|
| EP | 2982636 A1 | 2/2016 |
| EP | 2982638 A1 | 2/2016 |

(Continued)

OTHER PUBLICATIONS

Extended European Search Report issued in corresponding European Application No. 16179022.5, dated Jan. 20, 2017 (8 pages).

*Primary Examiner* — Matthew R Buck

(74) *Attorney, Agent, or Firm* — Osha Liang LLP

(57) ABSTRACT

A method and heave compensator for eliminating snap-load and heave effects at offshore deposition of a load into or onto the sea or seabed involves a heave compensator suspended between the load and the lifting device having a relatively stiff stroke response at small to moderate stroke lengths and then a softer stroke response at larger stroke lengths to avoid exceeding the dynamical amplification factor (DAF)-limitations of the crane/lifting device or on the load.

21 Claims, 15 Drawing Sheets

(56) References Cited

U.S. PATENT DOCUMENTS

| | | | | |
|---|---|---|---|---|
| 9,440,829 | B2 * | 9/2016 | Sadiq | B66F 11/00 |
| 2004/0146363 | A1 * | 7/2004 | Gjedebo | E21B 19/006 405/224.4 |
| 2005/0074296 | A1 | 4/2005 | McCarty et al. | |
| 2015/0362039 | A1 * | 12/2015 | Cannell | E21B 19/002 188/267.2 |

FOREIGN PATENT DOCUMENTS

| | | | |
|---|---|---|---|
| FR | 2383876 | A2 | 10/1978 |
| NO | 20140672 | A1 | 12/2015 |
| WO | 2014/122527 | A2 | 8/2014 |

* cited by examiner

HEAVE COMPENSATOR AND METHOD FOR REDUCING THE RISK OF SNAP-LOADS DURING THE SPLASH-ZONE PHASE

FIELD OF TECHNOLOGY

Embodiments of the present invention relate to a heave compensator and a method for reducing the risk of snap-loads during the splash-zone phase when a load is deployed into the sea/water from a floating deployment vessel having a lifting device.

BACKGROUND

Offshore installations, such as offshore windmills, various process modules for subsea oil and gas exploration etc., are in many cases deployed by being transported on seagoing transport vessels out to the placement location, and thereafter lifted off the transport vessel by an on-board crane or crane located on another vessel and lowered into the sea, either to be located on the surface as a floating installation or lowered into the water to be installed on the sea floor.

The deployment, or more precise, the lifting operation of the load is sensitive to the weather conditions because sea wave induced movements of the deployment vessel may quickly cause unacceptable heave movements of the suspended load. This is particularly problematic for lifting of heavy cargoes and/or huge constructions form floating vessels.

There are several problems associated with heave movements of heavy suspended loads. The heave movements are typically difficult to predict and has an irregular cyclic nature causing irregularly varying accelerated motions of the suspended load.

The accelerated motions may cause unacceptably high tensions on the lifting equipment/crane and suspension points both when the load is suspended in air, and in particular when the load is immersed and in water. Then the drag force from the water mass may easily result in unacceptably high tension forces on the lifting equipment.

Another problem with heave movements is that they are causing difficulties to predict the vertical motion of the load. This is problematic both at the initial lifting phase and at the landing phase of the load, due to risk of the load ramming into the basement or deployment vessel causing structural damages to the load and/or deployment vessel or intended landing basement.

A further problematic phase in offshore lifts of heavy loads and/or large constructions is the passing through the so-called splash zone, which is when the load/construction is partially submerged into water. In this phase, water/sea waves may induce changes in the buoyance of the load/construction causing temporarily slack in the lifting cable and/or slings which often subsequently ends with a snap load when the cable and/or slings is suddenly tightened. Snap loads are problematic due to easily giving unacceptable high tension forces which in the worst case may cause the cable or sling to snap.

Based on lift engineering calculations, a weather window is predicted where safe operations can be done according to acceptance criteria. This may significantly reduce operability and create long periods of waiting before the acceptable wave conditions are established.

Thus, to avoid costly waiting periods where the transport vessel is laying inactive waiting for improved wave conditions allowing such deploying operations, it is a desire for amending these wave induced problems allowing performing the deployment in less favourable weather conditions.

It is common to alleviate these problems by employing a heave compensator. A heave compensator is a mechanism having a spring and/or dampening effect due to being able, when needed, to prolong or shorten the distance between the suspension point of the crane and the suspension point of the load, and thus substantially reduce the variations of the tension forces due to unintended movements during the lift. The heave compensator is typically arranged between the load and the crane, e.g. by being attached in one end to a clevis of the lifting cable of the crane and in the other end to the suspension point of the load.

From U.S. Pat. No. 3,842,603, it is known a crane load compensator for interconnection between a stationary crane and a ship-borne load having a double acting piston dividing a cylinder into primary and secondary chambers. A first accumulator having liquid in the lower portion thereof and air in the portion thereof is connected at the bottom through a first electrically actuated valve to the lower one of the chambers. A second accumulator having liquid in the lower portion and air in the upper portion is connected at the bottom to the other chamber. The first accumulator also has a second electrically actuated valve for supplying air under pressure to it and a third electrically actuated valve for releasing air under pressure therefrom. The second accumulator has a first pressure switch responsive to low air pressure in the second accumulator connected to the second valve and has a second pressure switch responsive to high pressure in the second accumulator connected to the third valve. The pressure of the air is used as a piston position indicator. In addition, the first valve is controlled by a manually operated switch. Also, there is a manually operated switch for placing in circuit the actuators for the second and third air valves. By manipulation of the valves manually and automatically, the load is cushioned and handled carefully despite variations in position between the ship and the crane.

From EP 2 982 638 A1 it is disclosed a heave compensator with adjustable dampening properties comprising a length extension device having an inner space divided by a slide-able piston into a vacuum chamber and a liquid filled chamber, a gas accumulator divided by a slide-able piston into a gas filled chamber and a liquid filled chamber, and eventually a gas tank having an expansion chamber, where the liquid and gas chamber are fluidly connected to each other with valve controlled conduits, and where the device comprises pressure and temperature sensors which register pressure and temperature in the gas- and liquid phases, and where the device further comprises a control unit comprising a signal receiving unit, a writeable computer memory, a data processing unit, and a signal transmitting unit, and where the data processing unit contains computer software which calculates suited amount of gas and gas pressure in the at least one gas accumulator and/or at least one gas tank based on the information of which lifting operation is going to be performed and which thereafter engages activation means such that the suited amount of gas and gas pressure are achieved and maintained during the different phases of the lifting operation.

EP 2 982 636 discloses a heave compensator for heavy lifts with adjustable dampening characteristics able to operate above and below the water line in environmental pressures ranging from the atmospheric up to several hundred atmospheres pressure, and further to a method for automatic regulation of the available stroke length of the heave compensator during the lifting operation, based on the realization that heave compensating devices utilising a slide-able piston as a volume expanding mechanism to reduce the tension forces upon relative movements between crane and load, may obtain a simple compact construction able to execute a range of different compensation functionalities by registering the pressure and temperature in the gas filled chambers of the device, and employing this information to regulate the amount of gas in the single gas filled chambers.

From NO 2014 0672 it is disclosed a self-regulating heave compensator comprising a cylinder having a slide-able piston with piston rod extending out of the cylinder and where the piston divides the inner space of the cylinder into an upper vacuum chamber and a lower liquid filled chamber. The heave compensator comprises further at least a first and a second accumulator having a slide-able piston which divides their inner space into a lower liquid filled chamber and an upper gas-filled chamber, and at least a first and a second gas tank, and where the first gas tank is filled with gas at a relatively low pressure and the second gas tank is filled with gas at a relatively high pressure. A first closable (with a valve) fluid passage is fluidly connecting the liquid in the lower chamber of the cylinder with the liquid of the lower chamber of the first accumulator. A second fluid passage (without valve) ensures free fluid communication between the gases of the first accumulator and the second accumulator. A third closable (with a valve) a fluid passage enables tapping off liquid (to the environment) from the second accumulator. A fourth closable (with a valve) fluid passage connects the gas phases of the first accumulator to the first gas tank, and a fifth closable (with a valve) fluid passage connects the gas phases of the first accumulator to the second gas tank.

WO 2014/122527 discloses a passive heave compensator comprising: a main hydraulic cylinder, including a moveable piston having a piston rod extendible through the main hydraulic cylinder and a piston head, a gas phase above the piston head, and at least one oil phase below the piston head separated by a boundary; an upper connection point associated with the main hydraulic cylinder and a lower connection point associated with the piston rod; and at least one accumulator, each accumulator having a moveable separator to divide the accumulator between a gas phase above the separator, and an oil phase below the separator, and each oil phase is in communication with an oil phase in the main hydraulic cylinder; characterized in that the main hydraulic cylinder further comprises a cylinder sleeve co-axial with the piston head to provide, in co-ordination with the piston head, the boundary between the gas phase and the at least one oil phase in the main hydraulic cylinder. In this way, the variation in the coordination between the shape, longitudinal position, or both of the piston head, which naturally must be smaller in cross-section than the cross-section of the main hydraulic cylinder, and the transverse extent of the cylinder sleeve, provides variation in the cross-sectional area of oil volume in the main hydraulic cylinder, and thus different damping effects along the length of the main hydraulic cylinder, which are available to the user.

From U.S. Pat. No. 7,934,561 it is known a depth compensated passive heave compensator with depth compensation comprising a first cylinder connected at its upper end to a vessel. A piston rod extends from a piston located within the first cylinder through the lower end thereof and is connected to subsea equipment. A second cylinder contains a compressed gas which maintains pressure beneath the piston of the first cylinder. The upper end of the first cylinder is connected to the upper end of a third cylinder having a piston mounted therein. A piston rod extending from the piston of third cylinder extends through the lower end thereof, thereby applying the pressure of the sea to the piston of the third cylinder.

From U.S. 2005/0074296 it is known a hydro-pneumatic tensioner including a barrel having an inner bore and a pressurized fluid contained within to form at least part of a primary accumulator having a preset volume of gas at a preselected pressure. A piston having a piston rod extending from an aperture in the barrel is slideably carried in the bore of the barrel and is in communication with the pressurized fluid and positioned to increase the fluid pressure when the piston strokes in the direction of the pressurized fluid. A secondary accumulator also has a preset volume of gas at a preselected pressure. A fluid separator maintains functional separation of the fluid volumes of the primary and secondary accumulators when the primary accumulator pressure is less than a preselected secondary accumulator pressure. The fluid separator allows functional combining of the fluid volumes of the primary and secondary accumulators when the primary accumulator pressure equals or is greater than the preselected secondary accumulator pressure

SUMMARY OF THE INVENTION

One or more embodiments of the present invention provide a heave compensator and method enabling improved control with snap-loads during lifting of heavy loads/constructions.

One or more embodiments of the present invention provide a heave compensator and method enabling improved control with snap-loads during lifting of heavy loads/constructions through the water surface/splash-zone in offshore lifting operations.

One or more embodiments of the present invention provide a heave compensator and method enabling improved control with weight compensation including depth compensation when lowering the load into water, improved control with snap-loads during the surface zone, landing compensation, etc.

One or more embodiments of the present invention are based on the realisation that the problem with snap-loads, i.e. the slackening of and subsequent abrupt tightening of sling(s) and/or cable(s) which may easily occur when a load being partially submerged (often termed as the splash-zone since the load is partially in the water and partially above the water surface) in water is moved/turned by water surface waves, may be substantially reduced or entirely avoided by applying a heave compensator suspended between the load and lifting device (e.g. the hook of a lifting crane's cable) having a relatively rapid response to changes in the relative position between the load and the lifting crane's suspension point. The heave compensator should advantageously ensure that a sufficiently strong tension force always is applied on the cable and slings to prevent them from becoming slack.

Safety precautions for heavy lifts offshore sometimes require that heave movements, hydrodynamic forces or whatever else which may amplify the tensile force induced by the load on the crane/lifting device, or on the load, is always within a pre-set maximum dynamical amplification factor ($DAF_{max}$). The dynamical amplification factor (DAF) is a dimensionless ratio of the tensile forces being induced at the moment on the crane/lifting device by the load over the tensile strength which would be induced by a static load (i.e. a non-moving freely suspended load in air).

Thus a DAF of e.g. 2 means that the weight of the load as sensed by the crane/lifting device at the moment corresponds to two times the static weight of the load, a DAF of e.g. 1 means that the weight of the load as sensed by the crane/lifting device at the moment corresponds to the static weight of the load (i.e. the sensible weight of a load suspended in air not subject to accelerated (heave) movements), etc. Thus $DAF_{stat}$, corresponding to the static weight of the load, is a constant equal to 1.

A rapid response may be obtained by having a heave compensator with a relatively stiff stroke response. A stiff stroke response means that the force needed to extend the piston of a heave compensator increases rapidly with the stroke length, which may have the unwanted side-effect that at large stroke lengths the heave compensator induces a tensile force on the crane/lifting device or on the load which exceeds the $DAF_{max}$, or a similarly unacceptable high tension force. Thus, when applying a heave compensator having a stiff stroke response, it is advantageous to limit the maximum tension force exerted on the lifting equipment/crane from the heave compensator at long stroke lengths. That is, the stroke response of the heave compensator may advantageously be stiff at relatively short stroke lengths, and then change to a considerably softer stroke response at relatively longer stroke lengths to avoid danger of exceeding the crane/lifting device's $DAF_{max}$, or a similarly unacceptable high tension force.

Thus, in a first aspect, one or more embodiments of the present invention relate to a heave compensator intended to be suspended between a lifting device and a load to be lifted, wherein the heave compensator comprises: a main piston housing (1) comprising:

- an upper end (2) having attachment means (3) for releasable attachment of the lifting device,
- a lower end (4) having an opening (5) adapted to provide a fluid tight enclosure around a piston rod,
- an inner space divided by a slide-able first piston (6) into an upper chamber (7) and a lower first liquid filled chamber (8), and
- a piston rod (9) having at a first end attachment means (12) for releasable attachment of the load, and which is at a second end attached to the piston (6), and which stretches through the liquid filled chamber (8) and further a distance out of the opening (5) at the lower end (4), a first accumulator (13) comprising:

- an upper end (14),
- a lower end (15), and
- an inner space divided by a slide-able piston (16) into an upper chamber (17) filled with a gas and a lower chamber (18) filled with a liquid, a second accumulator (21) comprising:

- an upper end (22),
- a lower end (23), and
- an inner space divided by a slide-able piston (24) into an upper chamber (25) filled with a gas and a lower chamber (26) filled with a liquid, and a liquid distribution circuit comprising:

- a liquid manifold (28),
- a first liquid conduit (10) which in a first end is fluidly connected to the liquid filled chamber (8) and in the other opposite end is fluidly connected to the liquid manifold (28),
- a second liquid conduit (19) which in a first end is fluidly connected to the liquid filled chamber (18) and in the other opposite end is fluidly connected to the liquid manifold (28),
- a third liquid conduit (27) which in a first end is fluidly connected to the liquid filled chamber (23) and in the other opposite end is fluidly connected to the liquid manifold (28), and wherein the total volume of liquid in the heave compensator is adapted such that when the piston (6) of the main piston housing (1) is in an initial position, which is the closest obtainable proximity of the upper end (2) of the cylindrical main piston housing (1), and the piston (24) of the second accumulator (21) is an initial position, which is the closest obtainable proximity of the lower end (23) of the second accumulator (21), the piston (16) becomes positioned substantially in the middle of the inner space of the first accumulator (13), and the amount of preloaded gas in chamber (17) of the first accumulator (13) is adapted to give a gas pressure of $p_1$ and the amount of preloaded gas in chamber (25) of the second accumulator (21) is adapted to give a gas pressure of $p_2$, where $p_2>p_1$, when the piston (16) of the first accumulator (13) and the piston (24) of the second accumulator (21) are in their initial working positions.

In a second aspect, one or more embodiments of the present invention relate to a method for reducing the risk of snap-loads during the splash-zone phase when a load is deployed into the sea/water from a floating deployment vessel having a lifting device, wherein the method comprises the following steps:

A) applying a heave compensator according to the first aspect of one or more embodiments of the present invention, B) preparing the heave compensator before commencing the lifting operation by:

- placing the piston (24) of the second accumulator (21) in a lower position in the closest possible proximity to the second end (23), and
- loading the upper chamber (25) of the second accumulator (21) with an amount of a gas sufficient to obtain gas pressure $p_2$, and
- loading the upper chamber (17) of the first accumulator (13) with an amount of a gas sufficient to obtain gas pressure $p_1$, wherein $p_1<p_2$, and
- releasable attaching a lifting device to the attachment means (3) and releasable attaching the load to the attachment means (12), and C) executing the dry-zone phase of the lifting operation by lifting of the load from its basement of the deployment vessel by the lifting device, and G) executing the splash-zone phase of the lifting operation by lowering the load to make contact with the water/sea by use of the lifting device.

Alternatively, one or more of the liquid conduits of the heave compensator according to the first and second aspect of one or more embodiments of the present invention may further comprise a valve enabling regulating the flow rate of liquid through the liquid conduits. Which of the first (10), second (19) and third (27) liquid conduit which is to be equipped with a valve depends on the intended function of regulating the flow of liquid through the conduit(s). One or more embodiments of the present invention thus include any configuration of valves on one, two or all of the liquid conduits being present in the heave compensator.

In one example embodiment, the heave compensator according to the first and second aspect of one or more embodiments of the present invention is equipped with a configuration of valves enabling regulating the flow of liquid into and out of the liquid filled chamber (8) of the main piston housing (1). This functionality enables regulating the dampening effect of the heave compensator by regulating the flow resistance for the liquid flowing in and out of the liquid filled chamber (8). It also enables locking the piston (6) of the main piston housing (1) by shutting the one or more valve(s) regulating the flow of liquid into and out of the liquid filled chamber (8). The regulation of the flow of liquid into and out of the liquid filled chamber (8) may be obtained by several configurations:

1) having a valve (11) on the first liquid conduit (10),
2) having a valve (11) on the first liquid conduit (10) and a valve (20) on the second liquid conduit (19),
3) having a valve (11) on the first liquid conduit (10), a valve (20) on the second liquid conduit (19) and a valve (80) on the third liquid conduit (27), and
4) having a valve (20) on the second liquid conduit (19) and a valve (80) on the third liquid conduit (27).

Thus, the term "the valve being applied on the at least one of the first (10), second (19) and third liquid (27) conduits is able to regulate the flow of liquid into and out of the liquid filled chamber (8) of the main piston housing (1)" as used herein means includes any combination of valves on the liquid conduits as defined by configurations 1) to 4) above.

When applying an example embodiment of the heave compensator according to the first aspect of one or more embodiments of the present invention including at least a valve (11) on the first liquid conduit (10), the method according to the second aspect of one or more embodiments of the present invention may further comprise;

a step A) applying a heave compensator according to any of claims 2-15 and which at least comprises a valve (11) on the first liquid conduit (10), a step B) further comprises opening valve (11) of the first liquid conduit (10), and if present, opening valve (20) of the second liquid conduit (19), after loading the upper chamber (25) of the second accumulator (21) with gas and before loading the upper chamber (17) of the first accumulator (13) with gas, and further comprising the following step to be performed after step C) and before step G):

D) if valve (11) of the first liquid conduit (10) is closed, open valve (11) after the load is lifted to a safe distance above its deployment vessel in order to engage the heave compensation effect of the heave compensator.

The term "valve" as used herein, includes any valve able to shut-off and opening a conduit from zero to full through-flow of fluid in the conduit. The valve may be a shut-off valve, i.e. a valve which either is open or closed, a throttle valve which may continuously regulate the cross-section of the conduit for fluid from zero to 100% opening, or any other type of valve. Due to the large pressure differences which may arise in heave compensators, it may advantageously be employed a bypass conduit with a pressure equalising valve across each valve in the heave compensator to be able to equalise the pressure difference gradually in a controlled manner, and thereafter opening the one or more of the respective valves for full through-flow.

The term "dry phase" as used herein, means the phase of a lifting operation for deploying a load into, or alternatively onto, a water phase from a deployment vessel by a lifting device/crane where the load is suspended freely in air. That is, the dry-zone phase extends from the moment the lifting device/crane begins to lift the load off its underlay on the deployment vessel until the load makes contact with the water/sea.

The term "preloaded gas" as used herein, means the amount of gas being introduced into the gas-filled chambers of the accumulators of the heave compensator before commencing a lifting operation.

The term "splash-zone phase" as used herein, means the phase of a lifting operation for deploying a load into, or alternatively onto, a water phase from a deployment vessel by a lifting device/crane from the moment the load has made contact with the water and become exposed to the movements of water surface waves, and until the load (if the load is to be deployed below the sea surface) is lowered to become fully submerged into the water/sea and there is no longer high risk of snap loads. A suited criterion for marking the ending of the splash-zone phase and beginning of the wet phase is when the heave compensator utilised in the lifting operation makes contact with the water/sea surface.

The term "wet phase" as used herein, means the phase of a lifting operation for deploying a load into a water phase from a deployment vessel by a lifting device/crane from the moment the load has become fully submerged into the water/sea and until it makes contact with the seabed/deployment basement.

As used herein, the position of the piston inside the main cylinder housing (or the position of the piston in one or more of the accumulators), will be related to the upper end of the main cylinder housing (or the upper end of the one or more accumulators) where the piston position per definition is set to zero, and then the piston position increases linearly towards the lower end where it is per definition is set to 1. Thus a piston position of 0.5 means the piston is exactly in the middle of the inner space of the main cylinder housing (or the one or more accumulators).

The term "having an opening adapted to provide a fluid tight enclosure around a piston rod" as used herein, means that the opening in the lower end of the main piston housing of the heave compensator is provided to allow the piston rod to extend out of the main piston housing without any significant leakage of the fluid, e.g. a hydraulic oil, from the lower chamber of the main piston housing through the opening, and likewise to prevent water (or other fluid) from intruding into the inner space of the main piston housing when the heave compensator is submerged into the sea etc. The formation of fluid tight enclosures around the piston rods of hydraulic main piston housings is an established and long used technology which is well known to a person skilled in the art, and thus needs no further description.

The main piston housing (1) may in one example embodiment be a piston cylinder. The liquid may advantageously be glycol based liquids such as i.e. the liquid sold under the trade mark Houghto Safe 105 or 273 CTF; however, one or more embodiments of the present invention may apply any non-compressible liquid with sufficient low freezing point and correspondingly high boiling point to avoid phase transformations at the pressures and temperatures that may arise in heave compensators.

The "stroke response" of the heave compensator according to the first and second aspect of one or more embodiments of the present invention is the spring resistance of the piston of the main piston housing of the heave compensator, i.e. the force at which the piston resists being displaced away from its equilibrium position. The spring resistance of the heave compensator according to the first and second aspect of one or more embodiments of the present invention is caused by the resistance of the gaseous phase present in one or both of the accumulators from being compressed (or expanded). The smaller the available compression volume becomes, the higher the resistance to further compression becomes, and thus the stiffer the stroke response becomes. Therefore, the term "stiff stroke response" as used herein, means a relatively high spring resistance of the main piston housing piston, i.e. that a relatively high additional force must be applied on the piston of the main piston housing to move it one unit length away from its equilibrium position.

Correspondingly, a "soft stroke response" means a relatively low spring resistance, i.e. that a relatively low additional force on the piston is needed to move it one unit length away from its equilibrium position. The additional force required to displace the piston in a heave compensator utilising a gas phase to provide the spring effect from its equilibrium position, increases exponentially with the stroke length.

The intended stiff stroke response of the heave accumulator according to the first or second aspect of one or more embodiments of the present invention is obtained by employing an amount of liquid (e.g. a hydraulic oil) in the heave compensator adapted such that the piston (16) of the first accumulator (13) becomes positioned approximately in the middle of the inner space of the accumulator causing the available compression volume of the upper gas filled chamber (17) of the first accumulator (13) to become relatively small. Thus, the term "initial position" as used herein, means that the pistons of the cylindrical main piston housing and the second accumulator are placed in a position making the heave compensator ready for use for heave compensation during a lift involving submerging a load through the water/sea surface. Thus, unless specified otherwise, the initial position of the piston (6) of the main piston housing (1) is in an upper position as close as possible to the first end (2) of the main piston housing (1), and the initial position of the piston (24) of the second accumulator (21) is in a lower position as close as possible to the second end (23) of the second accumulator (21).

Furthermore, the term "positioned substantially in the middle of the inner space of the first accumulator" as used herein indicates that the initial position of the piston of the first accumulator does not necessarily need to be exactly in the middle of the inner space of the first accumulator. The heave compensator according to the first or second aspect of one or more embodiments of the present invention may function equally well with a range of initial positions of the piston (16) of the first accumulator (13), depending on the mass of the load and characteristics of the intended lifting operation. A feature of one or more embodiments of the present invention according to the first or second aspect is that the initial working position of piston (16) of the first accumulator (13) provides an upper chamber (17) with a smaller volume than the upper chamber (25) of the second accumulator when its piston (24) is in its initial position (close to the lower end 23), since this feature provides the intended stiff stroke response. Thus, the relative term "substantially in the middle" is applied to encompass a range of stroke response stiffness characteristics in one or more embodiments of the present invention according to the first or second aspect. This does not, however, make the claimed protection unclear to a person skilled in the art because a skilled person is capable from common general knowledge in the field to determine which volume the upper chamber (17) of the first accumulator should attain to provide the intended stroke response stiffness. It may in many appliances of the heave compensator according to the first or second aspect of one or more embodiments of the present invention be advantageous to adapt the total amount of liquid in the heave compensator to make the piston of the first accumulator, when the pistons of the main piston housing and the piston of the second accumulator are in their initial positions, to attain an initial position in the range from 0 to ¾, preferably from ¼ to ¾, more preferably from ⅓ to ⅔; more preferably from ⅖ to ⅗; or most preferably of 0.5. The term "total volume of fluid" as used herein, means the volume of all fluid present in the heave compensator including the lower chamber of the main piston housing, first accumulator, second accumulator, and liquid distribution circuit.

The $DAF_{max}$ limitation (more precisely, the amplification of the tensile forces) is particularly problematic for offshore lifting operations using a heave compensator having a stiff stroke response because the hydrodynamic forces in water can be very high and effectively withholding a partially or fully submerged object in the water mass if a heave movement of the crane/lifting device tries to move the object, and thus induce long stroke lengths which result in tensile strengths between the load and the crane/lifting device which exceeds $DAF_{max}$. The intended limitation of the tension force exerted on the lifting equipment/crane or the load too avoid exceeding the $DAF_{max}$, of the lifting equipment/crane or the load, is obtained according to the first or second aspect of one or more embodiments of the present invention by adapting the amount of gas being present in the gas-filled chamber of the first and the second accumulator such that if the piston of the main piston housing becomes drawn out to large stroke lengths, the gas inside the upper chamber of the first accumulator becomes sufficiently compressed to increase the pressure $p_1$ of the gas to the same pressure $p_2$ of the gas in the upper chamber of the second accumulator. From that moment the liquid being expelled from the lower chamber of the main piston housing will be distributed and flow into both the first and the second accumulator, and thus having available a considerably larger compression volume which gives a softer stroke response. That is, by loading the upper chamber (17) of the first accumulator (13) with a sufficient amount of gas, such as e.g. nitrogen gas, to acquire a pressure $p_1$ when the piston (16) of the first accumulator is in its initial working position and by loading the upper chamber (25) of the second accumulator (21) with a sufficient amount of gas, such as e.g. nitrogen gas, to acquire a pressure $p_2$ when the piston (24) of the second accumulator is in its initial working position, and where $p_1>p_1$, it is obtained that the liquid flowing in and out of the lower chamber (8) of the main piston housing is exchanged only with liquid flowing to and from the lower chamber (18) of the first accumulator as long as the gas pressure $p_1$ in the first accumulator is smaller than the gas pressure $p_2$ in the second accumulator. The gas pressure $p_1$ increases as the piston (6) of the main piston housing is being pulled downwards (towards the lower end 4) since the fluid exiting the lower chamber (8) of the main piston housing enters into the lower chamber (18) and thus compresses the gas in the upper chamber (17) of the first accumulator (13). If the downward stroke length becomes sufficient to increase the gas pressure $p_1$ of the first accumulator (13) to become equal the gas pressure $p_2$ of the second accumulator (21), the fluid exiting the lower chamber (8) of the main piston housing (1) will become distributed between the first and second accumulator. This has the effect of engaging the gas filled volume of the upper chamber (25) of the second accumulator (21) as available compression volume of the heave compensator, and thus changing the stroke response from the stiff response when only the first accumulator is engaged (as long as $p_1<p_2$), to a substantially softer stroke response when both accumulators are engaged (when $p_1=p_2$). The change in stroke response of the heave compensator according to the first or second aspect of one or more embodiments of the present invention when $p_1$ becomes equal to $p_2$ is significant due the relative huge volume of the gas filled chamber of the second accumulator as compared to the volume of the gas filled chamber of the first accumulator.

The working principle of the heave compensator according to the first or second aspect of one or more embodiments of the present invention may be schematically illustrated as shown in FIGS. 1*a*) to 1*c*). In FIG. 1*a*), the heave compensator according to the first or second aspect of one or more embodiments of the present invention is in a state where it is prepared for executing a lifting operation. This state is how the heave compensator according to the first or second aspect of one or more embodiments of the present invention usually will be configured at the initial lift-off phase, i.e. when the load is being lifted up from its deployment vessel.

As seen on FIG. 1*a*), the heave compensator in this prepared stage has the piston (24) of the second accumulator (21) in a position in close proximity of the lower end (23). This is the initial position of the piston (24) of the second accumulator (21). The gas filled chamber (25) of the second accumulator is having the maximum available volume, and is filled with a gas at a relatively high pressure $p_2$. The piston (6) of the main piston housing (1) is located in an upper position in close proximity to the first end (2). This is the initial position of the piston (6) of the main piston housing (1). The lower chamber (8) of the main piston housing is having its maximum attainable volume and is filled with a liquid. The piston (16) of the first accumulator (13) is shown to be located approximately in the middle of the inner space of the first accumulator. This is the initial position of the piston (16) of the first accumulator (13) in this example embodiment. The piston may, as described above, attain other initial positions, depending on the amount of liquid being applied in the heave compensator. The lift of the load is being commenced by attaching the heave compensator to a lifting device (not shown) by the attachment means (3) and to a load (not shown) by attachment means (12), and then engaging the lifting device.

The liquid distribution circuit establishes a fluid communication between the liquid in the lower chamber (8) of the main piston housing (1), the liquid in the lower chamber (18) of the first accumulator (13) and the liquid in the lower chamber (26) of the second accumulator (21). Since the liquid is free to flow between the main piston housing (1) and the first accumulator (13), the piston (16) and the gas in the upper chamber (17) of the first accumulator feels the weight of the load which pulls on the piston (6) of the main piston housing (1). Consequently, when the weight of the load pulls on piston (6) of the main piston housing (1), the piston (6) will be displaced a distance towards the lower end (4) of the main piston housing, which pushes a volume of liquid out of the chamber (8). This is indicated in FIG. 1*b*) by a somewhat lower position of the piston (6) as compared to the initial position shown in FIG. 1*a*). The space "left behind" by the piston (6) of the main piston housing (1) when it is displaced downwards defines an upper chamber (7). This space will in effect be a vacuum chamber when the upper end (2) of the main piston housing (1) is closed towards the ambient atmosphere/environment. Even though all presented example embodiments shown herein involves closed upper ends (2), it is envisioned using e.g. a separate oil filled accumulator in fluid communication with the upper chamber (7), similarly as shown in e.g. U.S. 2008/251980. Thus the heave compensator according to any aspect of one or more embodiments of the present invention encompasses an example embodiment having an upper end (2) of the main piston housing having a fluid outlet.

As long as the gas pressure $p_1$ (of the first accumulator) is smaller than gas pressure $p_2$ (of the second accumulator), the volume of liquid being expelled from chamber (8) of the main piston housing (1) enters into the lower chamber (18) and pushes the piston (16) upwards, i.e. closer to the upper end (14), and which compresses the gas in the upper chamber (17) and thus increases the gas pressure $p_1$. This effect is illustrated in FIG. 1*b*) by showing the piston (16) in a somewhat higher position as compared in FIG. 1*a*).

The positions of the piston (6) of the main piston housing (1) and the piston (16) of the first accumulator (13) shown in FIG. 1*b*) is herein termed the "initial working position". The initial working position is the equilibrium position over which the pistons (6) and (16) are fluctuating due to the varying dynamic amplification of the loads static weight due to the heave movements when the load is freely suspended in air. This fluctuating up- and down movements of the pistons (6) and (16) are indicated by the dotted arrows on FIG. 1*b*). The position of piston (24) of the second accumulator (21) is unchanged (as long as $p_2>p_1$). Thus the initial position and the initial working position of the piston (24) are identical because the amount of gas in chamber (17) of the first accumulator and the amount of gas in chamber (25) of the second accumulator is, according to first or second aspect of one or more embodiments of the present invention, adapted such that $p_2>p_1$ when the pistons of the main piston housing and the first (and second) accumulator are in their initial working positions.

The term "equilibrium position" as used herein, is the position over which the piston(s) is(are) fluctuating due to the heave movements. The equilibrium position of a piston is thus the position the piston will attain if the sensible weight of a load is static, i.e. without any dynamic amplification of the sensible weight. The term "initial working position" (shown in FIG. 1*b*)) as used herein should thus not be confused with the term "initial position" (shown in FIG. 1*a*)), which is the position attained by the piston of first accumulator when the piston of the main piston housing is in the uppermost position and the piston of the second accumulator is in its lowermost position, while the initial working position is the equilibrium position of the pistons when the load is suspended from the heave compensator in air.

If the stroke length of the main piston housing becomes sufficiently large to make $p_1$ equal to $p_2$, the liquid exiting the main piston housing will begin flowing into both the first and second accumulator. This situation is illustrated in FIG. 1*c*).

The engagement of the second accumulator shifts the stroke response of the heave compensator to a considerably softer response such that stretching out the piston of the main piston housing to further larger stroke lengths does not result in unacceptable increases in the DAF, as illustrated schematically in FIG. 1*d*). The figure illustrates the tensile strength curve of the heave compensator according to the first or second aspect of one or more embodiments of the present invention, i.e. the force required to stretch out the piston as function of stroke length. As seen on the figure, in this example embodiment, the piston of the heave compensator will be stretched to a stroke length of about ¼ of its maximum stroke length when it feels the static weight of the load (DAF=1). This is marked by the stapled lines intersecting at the point marked A on the figure. The heave compensator is now in the state illustrated schematically in FIG. 1*b*), where pistons of the main piston housing, the first accumulator and the second accumulator are in their initial working positions.

As the stroke length increases, the sensible weight of the load (i.e. the DAF) increases rapidly up to about e.g. DAF=1.5 (or similarly strong tension force on the crane/lifting device and/or load), due to the stiff stroke response when only the first accumulator is engaged. The tensile strength curve has a breaking point marked with letter B. This breaking point is the result of the pressure $p_1$ reaching $p_2$ such that the second accumulator becomes engaged in providing the spring of the piston of the main piston housing. From then on, the stroke length may increase with a much smaller relative increase in the DAF. The heave compensator is now in the state schematically illustrated in FIG. 1*c*). Also, as seen on FIG. 1*d*), if a heave compensator having a single accumulator providing a similar stiff stroke response as the first accumulator of this example embodiment was to operate on a lift having a $DAF_{max}$ of 2, this $DAF_{max}$ would be exceeded before the stroke length reaches ½ of the available stroke length. However, the heave accumulator according to the first or second aspect of one or more embodiments of the present invention will not reach DAF=2 until the stroke length has reached the maximum stroke of the heave compensator.

The force at which a load of mass, $m_{load}$, pulls on the piston (6) of the main piston housing, when being suspended in air from the piston rod (9) of the main positon housing (1) in air and without any dynamic amplification (i.e. the static weight of the load which corresponds to DAF=1), is:

$$F_{static}=m_{load}\cdot g \tag{1}$$

where g is the gravity of Earth (i.e. the acceleration at which the Earth gravity imparts to objects at its surface) and $F_{static}$ is the force needed to lift the load from the ground. Taking the dynamic amplification into consideration, the force pulling downwardly on piston (6) of the main piston housing (1) becomes:

$$F_{dynamic}(t)=\mathrm{DAF}(t)\cdot m_{load}\cdot g \tag{2}$$

where $F_{dynamic}(t)$ is the force pulling downwardly on piston (6) at time t, and DAF(t) is the dynamic amplification at time t.

The vacuum inside chamber (7) pulls upwardly on piston (6) with a force:

$$F_{vac}=p_{atm}\cdot A_m \tag{3}$$

where $p_{atm}$ is the atmospheric pressure and $A_m$ is the surface area of the upper side of piston (6) of the main piston housing (1). It is set an implicit premise here that the mass, $m_{load}$, of the load to be lifted is sufficiently large to enable pulling out the piston rod of the main piston housing against the retraction force created by the vacuum in chamber (7). This premise is in practice always true because heave compensators are intended for and being applied for lifting of heavy loads where there is danger of exceeding the lifting capability of the crane/lifting device if the load is subject to heave movements.

Thus, when a load of $mass_{load}$ is suspended (in air) from the heave compensator according to first or second aspect of one or more embodiments of the present invention, the net force which needs to be balanced by the gas of chamber (17) pushing on the piston (16) of the first accumulator (13) becomes:

$$F_{net}(t)=p_1\cdot A_1\mathrm{DAF}(t)\cdot m_{load}\cdot g-p_{atm}\cdot A_m \tag{4}$$

where $p_1$ is the gas pressure in chamber (17) of the first accumulator and $A_1$ is the upper surface area of piston (16) of the first accumulator. Eqn. 4 applies as long as the dynamic amplification of the loads weight does not result in that the gas pressure $p_1$ in the first accumulator increases to reach the same pressure as $p_2$ in the second accumulator.

Eqn. 4 combined with a gas equation of state provides the amount of gas which should be pre-loaded into chamber (17) of the first gas accumulator (13) to balance the static weight (i.e. DAF(t) is equal to $DAF_{stat}$ which is a constant equal to 1) of a load of mass $m_{load}$:

$$n_1=p_1V_1/R\cdot T=V_1(m_{load}\cdot g-p_{atm}\cdot A_m)/(R\cdot T\cdot A_1) \tag{5}$$

where $V_1$ is the volume of the upper chamber (17) when piston (16) is in its initial working position, R is the gas constant and T is the temperature of the gas.

The pressure, $p_2$, in the upper gas chamber (25) of the second gas accumulator (21) needs to be higher than the pressure $p_1$ of the upper chamber (17) of the first accumulator in order to ensure that only the first accumulator is engaged in the heave compensation at small and moderate stroke lengths to have the intended stiff stroke response. Thus pressure $p_2$ may be determined by the following expression:

$$p_2=\gamma_1\cdot p_1 \tag{7}$$

where $\gamma_1$ is a constant in the range of [1.1, $0.95\cdot DAF_{max}$], preferably of [1.15, $0.90\cdot DAF_{max}$], more preferably of [1.20, $0.85\cdot DAF_{max}$], and most preferably $(DAF_{stat}+DAF_{max})/2$. These ranges are based on the assumption that the value of the maximum allowable dynamical amplification ($DAF_{max}$) for the load and/or lifting device is at least 1.5. This assumption will in practice always be the fulfilled.

Eqn. 7 combined with a gas equation of state provides the amount of gas which should be pre-loaded into chamber (25) of the second gas accumulator (21) to balance the sensible weight of a load of mass $m_{load}$, which in the case of applying the ideal gas law as the gas equation of state gives:

$$n_2=p_2V_2/R\cdot T=V_2\cdot\gamma_1\cdot\mathrm{DAF}_{stat}(m_{load}\cdot g-p_{atm}\cdot A_m)/(R\cdot T\cdot A_1) \tag{8}$$

where $V_2$ is the volume of the upper chamber (21) when piston (24) is in its initial working position, $DAF_{stat}$ is the force at which a static load of mass, $m_{load}$, pulls on the piston (6) of the main piston housing and $\gamma_1$ is a real number constant having a value as indicated above.

Eqns. (5) and (8) for determination of the amount of gas to be preloaded into the gas chamber of the first and second accumulator is based on the ideal gas equation of state which is an acceptable approximation to real gases up to about 20-30 bar pressure. If higher gas pressures are involved, the amount of gas to be preloaded into the first and second gas accumulator may advantageously be determined by applying another gas equation of state, such as e.g. the Van der Waal's equation for real gases, Peng-Robinson gas equation of state, etc.

The term "$DAF_{max}$" as used herein, is the maximum allowable dynamical amplification of the tensile forces on the crane/lifting device and/or load during an offshore lifting operation. Often the $DAF_{max}$ limit is defined in advance as a safety precaution by the operator/contractor of the lifting operation. If not, the method according to the present applies a $DAF_{max}$ value estimated by the crane operator of the heave compensator based on experience. In practice, $DAF_{max}$, is at least 1.5.

The notation for intervals as used herein follows the international standard ISO 80000-2, where the brackets "["

and "]" indicate a closed interval border, and parenthesises "(" and ")" indicate an open interval border. For example, "the range of [a, b]" is the closed interval containing every real number from a included to b included: $[a, b]=\{x\in \mathbb{R} \mid a\leq x\leq b\}$, while "the range of (a, b]" is the left half-open interval from a excluded to b included: $(a,b]=\{x\in \mathbb{R} \mid a<x\geq b\}$.

The heave compensator according to the first or second aspect of one or more embodiments of the present invention may in an alternative embodiment additionally comprise a gas distribution circuit comprising:

a first gas conduit (29) fluidly connected to the gas filled chamber (17) of the first accumulator (13), the first gas conduit (29) has a valve (30) for regulating the flow of gas in the gas conduit, a second gas conduit (31) fluidly connected to the gas filled chamber (25) of the second accumulator (21), the second gas conduit (31) has a valve (32) for regulating the flow of gas in the gas conduit, a third gas conduit (33) fluidly connected to the environment, the third gas conduit (33) has a valve (34) for regulating the flow of gas in the gas conduit, and a gas manifold (35) fluidly interconnecting the first (29), the second (31), and the third (33) gas conduits.

The valves (30, 32, 34) on the first (29), second (31), and third (33) gas conduits, respectively, will normally be closed during a lift such that no gas is allowed flowing through the gas conduits. However, the gas distribution circuit enables changing the amount of gas inside the gas-filled chamber of one or both of the first and second accumulators during a lifting operation, and thus providing the heave compensator with the possibility of exhibiting a range of different heave compensation functionalities. One such possibility is allowing adjusting the initial working position of the piston of the main piston housing at the stage of the lifting operation where the load has been lifted above its basement of the deployment vessel and is being hoisted towards the point where it is to be lowered into the sea by changing the amount of gas inside the gas filled chamber (17) of the first (13) accumulator. This functionality is advantageous in cases where the correct mass of the load, $m_{load}$, is not known in advance and in cases where the estimate of the mass of the load is sufficiently inaccurate to result in a pre-loading of gas inside the accumulator(s) resulting in a non-optimum performance of the heave compensator.

This situation may be alleviated once the load is lifted up and freely suspended above its deployment vessel by either bleeding off an amount of gas from the first accumulator, or the opposite, to insert an amount of gas extracted from the second accumulator into the upper chamber (17) of the first gas accumulator (13). The bleeding off of an amount of gas may be obtained by opening valves (30) of the first gas conduit (29) and valve (34) of the third gas conduit (33) to vent off the intended amount of gas to the environment and then closing both valves. The injection of more gas into the upper chamber (17) may be obtained by opening valve (30) of the first gas conduit (29) and valve (32) of the second gas conduit (31) such that the intended amount of gas flows from the second gas accumulator (21) and into the first gas accumulator (13), and then shutting the valves. The latter requires that the pressure $p_2$ of the second accumulator is sufficiently larger than $p_1$ of the first accumulator. In the practical life, this requirement will almost always be fulfilled since it is required a relatively large pressure difference between the first and second accumulator to obtain the intended range of stroke lengths having stiff stroke response before the heave compensator changes to a soft stroke response (at e.g. point B in FIG. 1*d*).

The opening and closing of the valves (11, 20, 30, 32, and 34) of the heave compensator according to the first aspect may advantageously be obtained by activation means, such as e.g. an actuator, on each valve to allow separate engagement of the valves. Thus, in an alternative embodiment, the heave compensator according to one or more embodiments of the present invention further comprises a first activation means regulating the opening of valve (11) on the first liquid conduit (10), a second activation means regulating the opening of valve (20) on the second liquid conduit (19), a third activation means regulating the opening of valve (30) on the first gas conduit (29), a fourth activation means regulating the opening of valve (32) on the second gas conduit (31), and a fifth activation means regulating the opening of valve (34) on the third gas conduit (33). Each of the first to the fifth activation means may advantageously have communication means for receiving instruction signals for changing the valve opening and means for executing the regulation of the valve according to the instruction signal. The instruction signal may be any known type of electronic signal, such as e.g. a radio transmitted signal, an electric signal transmitted by wire etc. or by hydraulic control.

The instruction signals for activation of the activation means changing the required valve openings for adjusting the initial working position (which is similar to the equilibrium position as long as the load is lifted up from its deployment vessel and before entering the water) of the piston of the main piston housing may be produced and regulated manually by an operator via e.g. a remote control etc. Alternatively, the instruction signals may be produced fully automatically by the heave compensator itself without any operator feedback if it is equipped with sensors which measures the pressure and temperature of the gas phase in at least the first accumulator and the position of the piston of the main piston housing, and a control unit having computer software which enables determining the equilibrium position of the piston of the main piston housing as from the sensor data, and then determine whether it is necessary to either venting off an amount of gas from the first accumulator or to extract an amount of gas from the second accumulator into the first accumulator as described above, and which enables engaging and controlling the activation means on the valves of the gas distribution circuit to obtain the intended venting off or injection of gas out off/into the first accumulator.

The applicant has described and sought protected prior art heave compensators with implemented control unit and sensors system for automatic adjustments of the equilibrium position (which is the same as the initial working position as long as the load is lifted up from its deployment vessel and before entering the water) of the piston of the main piston housing in EP 2 982 638 A1 and in EP 2 982 636 A1. Both documents are hereby incorporated in their entirety herein by reference. The control unit and sensor system, and how they may be utilised to provide the heave compensator with different functionalities such as depth compensation, stroke response adjustment, etc. is described in detail in paragraphs [0014]-[0015], [0018], [0020]-[0022], [0038], [0043], [0045]-[0047], and in particular in paragraphs [0051]-[0063], [0067] and [0069]-[0070] of EP 2 982 638 A1, and in paragraphs [0014]-[0015], [0019], [0021], [0023]-[0025], [0033]-[0048], and in particular in paragraphs [0054]-[0070] of EP 2 982 636 A1.

The features of EP 2 982 636 A1 and EP 2 982 638 A1 enabling automatic adjustments of the stroke length (and thus also adjusting the initial working position), which hereby will be stated as the third aspect of one or more embodiments of the present invention and which is shown schematically in FIG. 3, may be implemented in an example embodiment of the present heave compensator as follows:

The heave compensator according to the third aspect of one or more embodiments of the present invention comprises the example embodiment of the first aspect of one or more embodiments of the present invention including the gas distribution circuit, and comprises further:

a pressure and temperature sensor located (41) in the gas-filled chamber (17) of the first accumulator (13), a pressure and temperature sensor (42) located in the gas-filled chamber (25) of the second accumulator (21), a position sensor (40) located on the piston (6) of the main piston housing (1), an optional position sensor (43) located on the piston (16) of the first accumulator (13), an optional position sensor (44) located on the piston (24) of the second accumulator (21), an optional pressure and temperature sensor (45) located in the lower chamber (8) of the main piston housing (1), an optional pressure and temperature sensor (46) located on the outside of the heave compensator for measuring the (water) pressure and temperature of the heave compensators surroundings, and a control unit (not shown in the figures) comprising:

means for registering the continuously measured temperatures and/or pressures by each of the pressure and temperature sensors being applied in the heave compensator, means for registering the continuously measured position of the piston(s) by each of the position sensors being applied in the heave compensator, means for continuously determining the equilibrium position to piston (6) of the main piston housing and optionally also piston (16) and/or piston (24) of the first (13) and the second (21) accumulator, respectively, from the registered temperatures and/or pressures, and eventual registered piston positions, means for determining the amount of gas which needs to be ventilated out of, or alternatively injected into the upper chamber (17) of the first accumulator (13) in order to obtain an intended equilibrium position of piston (6), and means for separately engaging the activating means of valve (30) of the first gas conduit (29) and valve (34) of the third gas conduit (33) to ventilate out the determined amount of gas which needs to be ventilated out of the upper chamber (17) of the first accumulator (13), or alternatively, separately engaging the activating means of valve (30) of the first gas conduit (29) and valve (32) of the second gas conduit (31) to transfer the determined amount of gas which needs to be injected into the upper chamber (17) of the first accumulator (13) from the second accumulator (21).

In a fourth aspect, one or more embodiments of the present invention relate to a method for combined snap-load compensation and automatic adjustment of the equilibrium position of the piston (6) of the main piston housing, which comprises the method according to the second aspect of one or more embodiments of the present invention with the addition that the heave compensator that is to be applied, is a heave compensator according to the third aspect of one or more embodiments of the present invention, and in that it further comprises the following process step which is to be applied after step D) and before step G):

E) determining the equilibrium position of piston (6) of the main piston housing (1) by:

1) measuring the position of piston (6) of the main piston housing (1) by the position sensor (40) and employing the measured positions to determine the measured equilibrium position, $S_k$, of the piston, 2) comparing the measured equilibrium position, $S_k$, with a predetermined intended equilibrium position $S_0$, of the piston (6), and 3) determine the difference $|S_0-S_k|$, F) execute the dry phase adjustment of the equilibrium position of piston (6) of the main piston housing (1) by the following sub-process steps:

1) if $|S_0-S_k|<K_1$, where $K_1$ is a predetermined adjustment threshold criteria, then abort the dry phase adjustment of the equilibrium position and go directly to step G) below, or else continue to sub-step 2) below:

2) if $S_0-S_k>0$, then:

i) open valve (30) on the first gas conduit (29) and valve (34) on the third gas conduit (33), ii) continuously measuring the position of piston (6) of the main piston housing (1) by the position sensor (40) and employing the measured positions to continuously determine the measured equilibrium position, $S_k$, of the piston, and then continuously determining the difference $|S_0-S_k|$ and comparing it with the predetermined adjustment threshold criteria, and if $|S_0-S_k|<K_1$, close valve (30) on the first gas conduit (29) and valve (34) on the third gas conduit (33), and go directly to step G), or:

3) if $S_0-S_k<0$, then:

j) open valve (30) on the first gas conduit (29) and valve (32) on the second gas conduit (31), jj) continuously measuring the position of piston (6) of the main piston housing (1) by the position sensor (40) and employing the measured positions to continuously determine the measured equilibrium position, $S_k$, of the piston, and then continuously determining the difference $|S_0-S_k|$ and comparing it with the predetermined adjustment threshold criteria, and if $|S_0-S_k|<K_1$, close valve (30) on the first gas conduit (29) and valve (32) on the second gas conduit (31), and go directly to step G).

In the wet phase, i.e. when the load is completely submerged into the water phase, there is no longer a high risk of snap-loads. Thus, the snap-load functionality is no longer required when entering the wet phase. Furthermore, the risk of strong hydrodynamic retention forces (e.g. drag) on the submerged load exceeding the $DAF_{max}$, when heave movements seeks to move the submerged load has however become relatively high such that it is highly advantageous that the stroke response of the heave compensator according to any aspect of one or more embodiments of the present invention, changes to a considerably softer stroke response as soon as the load enters the wet phase below the splash-zone phase.

Thus, the method according to the fourth aspect of one or more embodiments of the present invention may advantageously further comprise a wet phase stroke response adjustment step, by including the following additional process step to be performed after step G):

H) equalising the pressures of the first and second gas accumulator by opening valve valve (30) on the first gas conduit (29) and valve (32) on the second gas conduit (31).

It may also be highly advantageous to make an adjustment of the equilibrium position of the piston of the main piston housing at the beginning of the wet phase to compensate for the buoyancy of the submerged load. Thus, the method according to the fourth aspect of one or more embodiments of the present invention may advantageously further comprise a wet phase adjustment of the equilibrium position of piston (6) of the main piston housing (1), by including the following additional process step to be performed after step H):

I) determining the equilibrium position of piston (6) of the main piston housing (1) by:

1) measuring the position of piston (6) of the main piston housing (1) by the position sensor (40) and employing the measured positions to determine the measured equilibrium position, $S_k$, of the piston,
2) comparing the measured equilibrium position, $S_k$, with a predetermined intended equilibrium position $S_0$, of the piston (6), and
3) determine the difference $|S_0|$, and J) execute the wet phase adjustment of the equilibrium position of piston (6) of the main piston housing (1) by performing the following sub-process step:

1) if $|S_0-S_k|<K_1$, where $K_1$ is a predetermined adjustment threshold criteria, then stop the wet phase adjustment of the equilibrium position, or else continue to sub-step 2) below:
2) i) open valve (34) on the third gas conduit (33), and ii) continuously measuring the position of piston (6) of the main piston housing (1) by the position sensor (40) and employing the measured positions to continuously determine the measured equilibrium position, $S_k$, of the piston, and then continuously determining the difference $|S_0-S_k|$ and comparing it with the predetermined adjustment threshold criteria, and if $|S_0-S_k|$ close valve (34) on the third gas conduit (33), and stop the wet phase adjustment of the equilibrium position of piston (6) of the main piston housing (1).

The adjustment threshold criteria $K_1$ may for example be set to be maximum 5% of the intended equilibrium position $S_0$. However, any other suited abort criteria for stopping the adjustment of the pistons equilibrium position may be applied.

Furthermore, in cases where the load is to be deployed in deep water, the wet phase adjustment of the equilibrium position of piston (6) of the main piston housing (1) may advantageously be repeated one or more times during the descent into the water mass to compensate for the increasing hydrostatic pressure with increasing water depths. Thus, the method according to the fourth aspect of one or more embodiments of the present invention may advantageously further comprise a deep water adjustment of the equilibrium position of piston (6) of the main piston housing (1), by including the following additional process step to be performed after step K):

L) determine the need for deep water adjustment of the equilibrium position of piston (6) of the main piston housing (1), and eventually perform the wet phase adjustment of the equilibrium position of piston (6) of the main piston housing (1) by executing step K).

The determination for the need for deep water adjustment of the equilibrium position of piston (6) of the main piston housing (1) may be controlled manually by an operator sending a signal to the heave compensator's control unit to perform the deep water adjustment of the equilibrium position. Preferably the control unit may automatically perform the deep water adjustment of the equilibrium position at regular time intervals, by use of e.g. a time keeping device, by utilising information from a pressure and temperature sensor (46) located on the outside of the heave compensator for measuring the (water) pressure and temperature of the heave compensators surroundings informing that the hydrostatic pressure has increased sufficiently to require a stroke adjustment, for instance at every 5 bar increase in the hydrostatic pressure, etc.

In a further example embodiment, one or more embodiments of the present invention according to any aspect may advantageously further comprise one or more additional accumulators, such as shown in FIGS. 4*a*) and 4*b*), which show an example embodiment with four accumulators according to the first aspect of one or more embodiments of the present invention. FIG. 4*c*) illustrates schematically a similar example embodiment according to the third aspect of one or more embodiments of the present invention. As may be seen from the FIGS. 4*a*) to 4*c*), the additional accumulators are fluidly connected to the liquid distribution circuit in the same manner as the first accumulator by a liquid conduit having a valve for controlling the flow of liquid in the conduit, and which in one end is fluidly connected to the liquid manifold (28) and in the other end to the lower liquid filled chamber of the respective accumulator. Similarly, as shown schematically in FIGS. 4*b*) and 4*c*), the additional accumulators are fluidly connected to the gas distribution manifold in the same manner as the first accumulator by a gas conduit having a valve for controlling the flow of gas in the conduit, and which in one end is fluidly connected to the gas distribution manifold (28) and in the other end to the upper gas filled chamber of the respective accumulator.

The example embodiment shown in FIG. 4*a*) contains an identical main piston housing (1), first accumulator (13) and second accumulator (21) connected together by an identical liquid distribution circuit as the heave compensator according to the first aspect of one or more embodiments of the present invention. In addition the example embodiment comprises a third accumulator (50) having a slide-able piston (53) dividing the inner space into a lower liquid filled chamber (55) and an upper gas filled chamber (54). At the lower end (52) there is a fourth liquid conduit (56) with a valve (57) which fluidly connects the lower chamber (55) to the liquid distribution manifold (28). Similarly, the fourth accumulator (58) has a slide-able piston (61) dividing the inner space into a lower liquid filled chamber (63) and an upper gas filled chamber (62). At the lower end (60) there is a fifth liquid conduit (64) with a valve (65) which fluidly connects the lower chamber (63) to the liquid distribution manifold (28).

The example embodiment shown in FIG. 4*b*) is identical to the example embodiment shown in FIG. 4*a*), and comprises further a gas distribution circuit similar to the first aspect of one or more embodiments of the present invention. That is, the upper chamber (54) of the third accumulator (50) is fluidly connected to the gas distribution manifold (35) by a fourth gas conduit (66) having a valve (67) and the upper chamber (62) of the fourth accumulator (58) is fluidly connected to the gas distribution manifold (35) by a fifth gas conduit (68) having a valve (69).

The example embodiment shown in FIG. 4*c*) is identical to the example embodiment shown in FIG. 4*a*), and comprises further a position sensor (70) for measuring the position of piston (53) of the third accumulator (50), a position sensor (71) for measuring the position of piston (61) of the fourth accumulator (58), a pressure and temperature sensor (72) for measuring the pressure and the temperature of the gas in the upper chamber (54) of the third accumulator (50), and a pressure and temperature sensor (73) for measuring the pressure and the temperature of the gas in the upper chamber (62) of the fourth accumulator (58).

One or more of the additional accumulators may be utilised as gas reservoir in the same manner, mutatis mutandis, as described in paragraphs [0016], [0027], [0035], [0038], [0041], and especially [0050] of EP 2 982 638 A1, by having the valves on the respective liquid conduits closed. This will provide the present heave compensator with the same heave compensation functionalities as described in the Examples 1-7 in paragraphs [0076]-[0107] of EP 2 982 638 A1.

Furthermore, the present heave compensator having more than two accumulators may also obtain a more versatile snap-load functionality according to one or more embodiments of the present invention, by having the third accumulator functioning as the second additional compression volume to enable a softer stroke response and thus preventing unacceptable high DAFs at large strokes in the same manner as the second accumulator works relative to the first accumulator as described above for the first to the fourth aspect of one or more embodiments of the present invention. By using three accumulators, one preloaded with gas at pressure $p_3$ and another preloaded with gas at pressure $p_2$, such that $p_3>p_2>p_1$, where $p_1$ is the gas pressure of the gas preloaded in the first accumulator, the dampening effect on the stroke response becomes more equal to the ideal stroke response curve. The ideal stroke response curve is shaped as the positive half of a logarithmic curve beginning in origo of a Cartesian diagram where the x-axis represents the stroke length and the y-axis represents the DAF, and which at first increases rapidly (in the y-value) with increasing x-value and then levels off asymptotically at higher x-values towards a y-value equal to $DAF_{max}$. The closer the heave compensator's stroke response come to the ideal stroke response curve, the more effective the dampening of the heave movements becomes since then the first accumulator may have a very stiff stroke response, the second accumulator may have a somewhat softer stroke response, the third accumulator an even more softer stroke response, and so on. This may be obtained by preloading the heave compensator with an adapted amount of liquid such that the initial working position of piston (16) of the first accumulator (13) is at e.g. ⅓ (as opposed to about ½ for example embodiments shown in FIGS. 1 and 2), the initial working position of both piston (24) of the second accumulator (21) and the initial working position of piston (53) of the third accumulator (50) becomes 1, as shown schematically in FIG. 4*c*). The amount of gas being preloaded into the upper chamber (17) of the first accumulator (13) may advantageously be adapted to obtain a pressure $p_1=(DAF_{stat}\cdot m_{load}\cdot g-p_{atm}\cdot A_m)/A_1$ at this initial working position of piston (16) of the first accumulator (13) at about ⅓.

The amount of gas being preloaded into the upper chamber (25) of the second accumulator (21) may advantageously be adapted to obtain a pressure $p_2$ at somewhat lower pressure than given above for pressure $p_2$ given for the example embodiments involving two accumulators. In this example embodiment, the preloaded gas pressure $p_2$ in the second accumulator may be $p_2=\gamma_2\cdot p_1$, where $\gamma_2$ is a real number constant having a value in the range of [1.2, $0.97\cdot DAF_{max}$], preferably of [1.3, $0.95\cdot DAF_{max}$], and most preferably $(DAF_{stat}+DAF_{max})/1.9$.

Likewise, the amount of gas being preloaded into the upper chamber (54) of the third accumulator (50) may advantageously be adapted to obtain a pressure $p_3$ at somewhat higher pressure than given above for pressure $p_2$. In this example embodiment, the preloaded gas pressure $p_3$ in the second accumulator may be $p_3=\gamma_3\cdot p_1$, where $\gamma_3$ is a real number constant having a value in the range of [1.3, $0.98\cdot DAF_{max}$], preferably of [1.4, $0.96\cdot DAF_{max}$], and most preferably of $(DAF_{stat}+DAF_{max})/1.8$. When the heave compensator is to be applied for the snap-load functionality, the $\gamma_1$, $\gamma_2$, and $\gamma_3$ values are to be chosen such that the preloaded amounts of gas result in that $p_3>p_2>p_1$.

The term "continuously measuring" as used in this context is not to be understood in the mathematical sense of the term as a non-interrupted measurement. Continuously as used in this context means a satisfactorily tightly connected series of measurements made at sufficiently small intervals to form a timely and satisfactorily correct representative picture of the variation of the variable being measured. How close the point measurements/registrations need to be performed to obtain this, depend on how rapidly the pressure or temperature changes in the gas phases of the heave compensating device. The determination of this in each case is within the ordinary skills of a person skilled in the art.

The term "position sensor" as used herein, is to be understood as any mean able to continuously measuring the position of the piston (6) inside the main piston housing (1) of the device, and feeding this information as an electric readable signal to a control unit having computer software which utilises the position data from the position sensor to calculate the equilibrium position of the piston. The position sensor may be located on any suited location in the device, including but not limited to, on the piston.

The term "pressure and temperature sensor" as used herein, is to be understood as any mean able to continuously measuring the pressure and the temperature of its environment and producing an electric signal representative of the pressure and temperature in the pressure and temperature range which may arise in the different chambers of heave compensators and their environments, and which may transfer this information via electric transfer means to a signal receiving unit for further treatment. The sensor may be a combined pressure and temperature sensor, or alternatively a separate pressure sensor and a separate temperature sensor. Embodiments of the present invention are not tied to use of any specific sensor, but may apply any known sensor able to measure the actual pressures and/or temperatures. Examples of suited sensors includes, bur are not restricted to; PTX 300 Series from GE, PTX 400 Series from GE, HYDAC ETS Series, HYDAC HDA Series, etc.

DETAILED DESCRIPTION OF THE INVENTION

The present invention will be described in greater detail by way of example embodiments.

Figure 1:
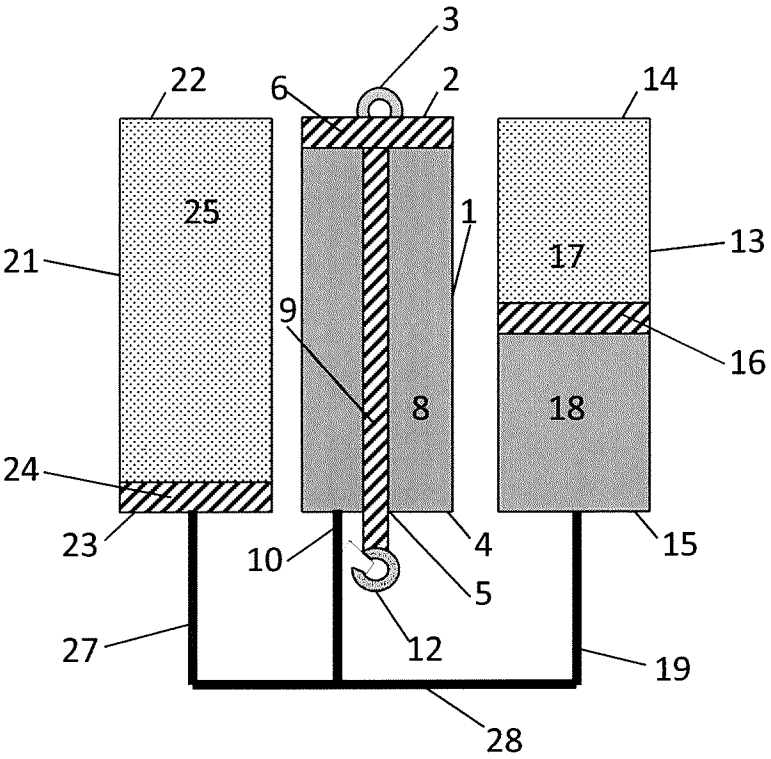
FIG. 1*a*) is a schematic view as seen from the side of an example embodiment of the heave compensator according to the first and second aspect of one or more embodiments of the present invention when the pistons are in the initial positions.
FIG. 1*b*) is a schematic view as seen from the side of the same heave compensator as shown in FIG. 1*a*), when the pistons are in the initial working positions.
FIG. 1*c*) is a schematic view as seen from the side of the same heave compensator as shown in FIGS. 1*a*) and 1*b*), when the pistons are in a typical working position at relatively large strokes.
FIG. 1*d*) is a graph illustrating the stroke response curve of the example embodiment of the heave compensator shown in FIGS. 1*a*) to 1*c*).
Figure 1:
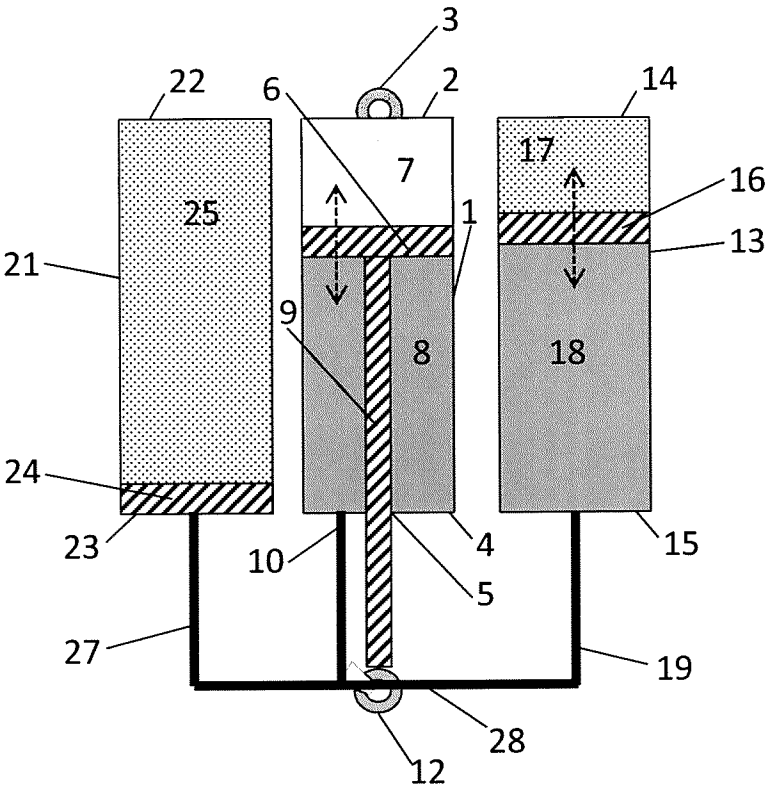
Figure 1:
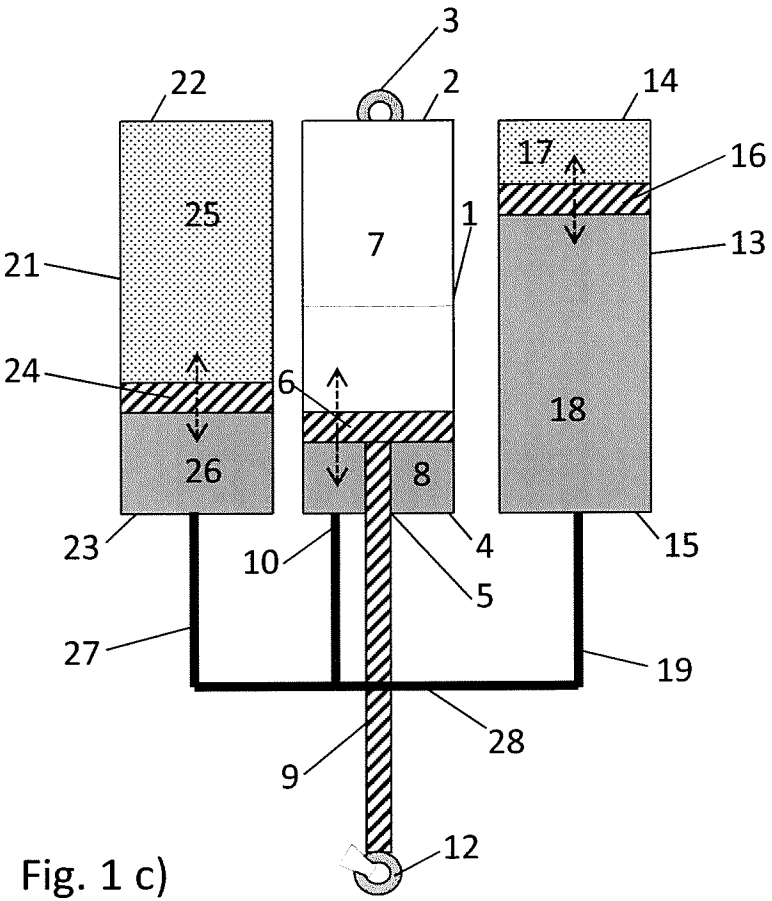
Figure 1:
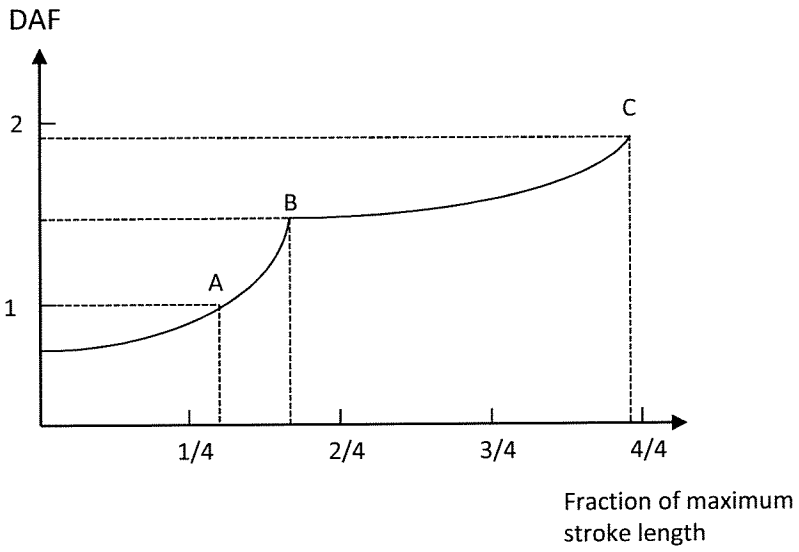
Figure 2:
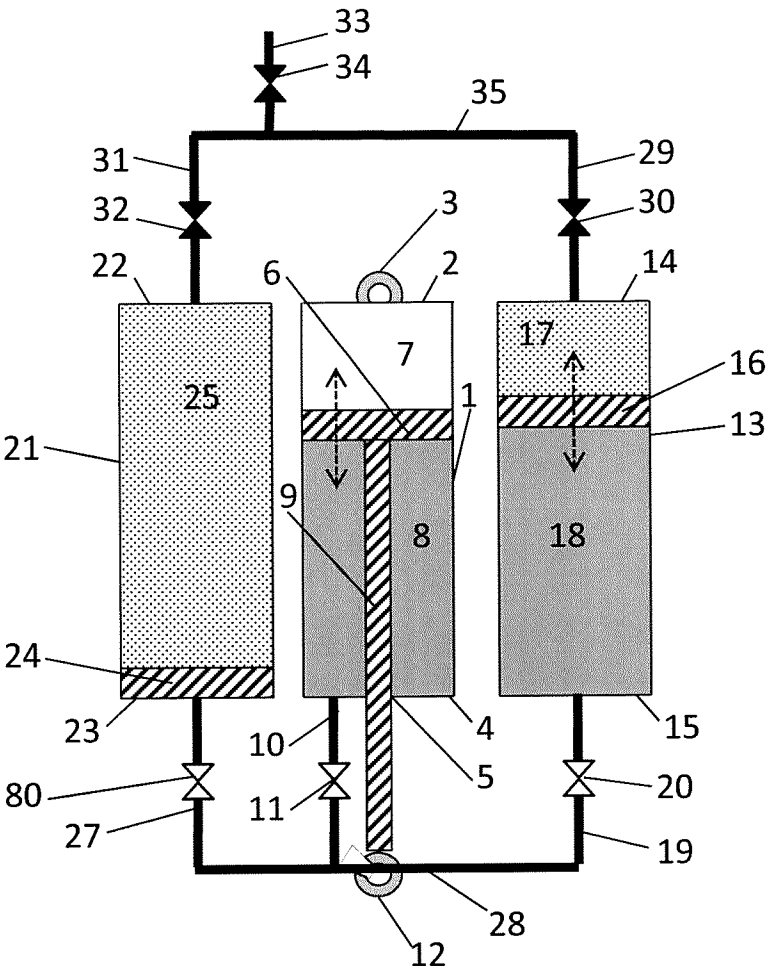
FIG. 2 is a schematic view as seen from the side of another example embodiment of a heave compensator according to the first and second aspect of one or more embodiments of the present invention which includes a gas distribution circuit.
Figure 3:
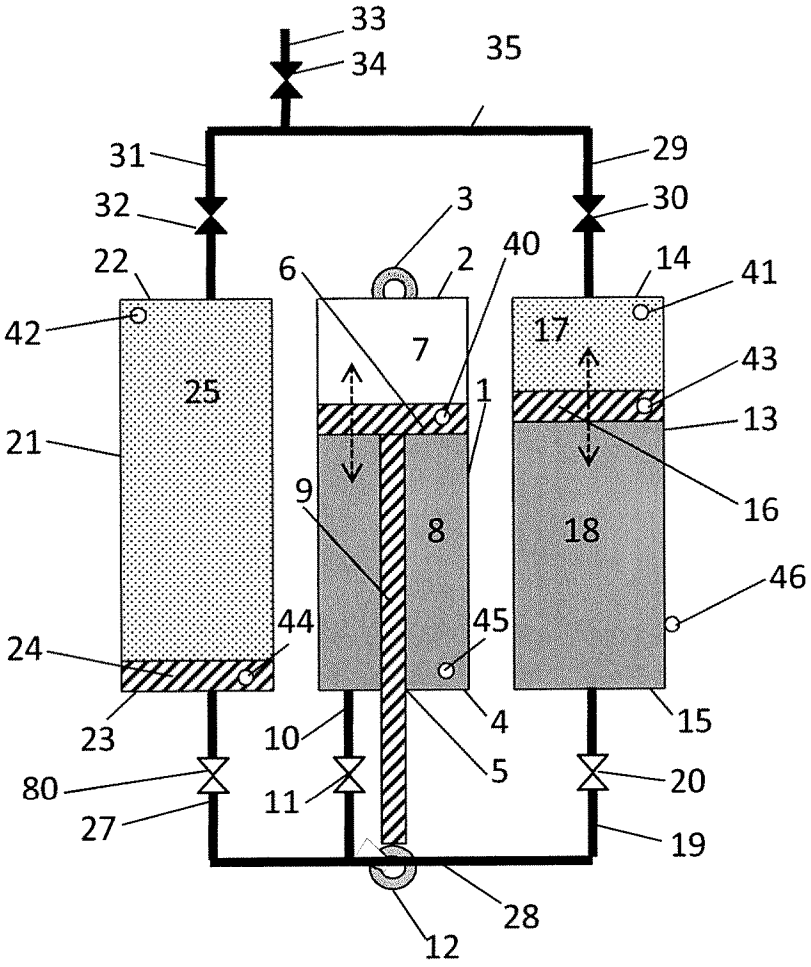
FIG. 3 is a schematic view as seen from the side of another example embodiment of a heave compensator according to the third and fourth aspect of one or more embodiments of the present invention by including sensor automatics for automatic regulation of the heave compensator.
Figure 4:
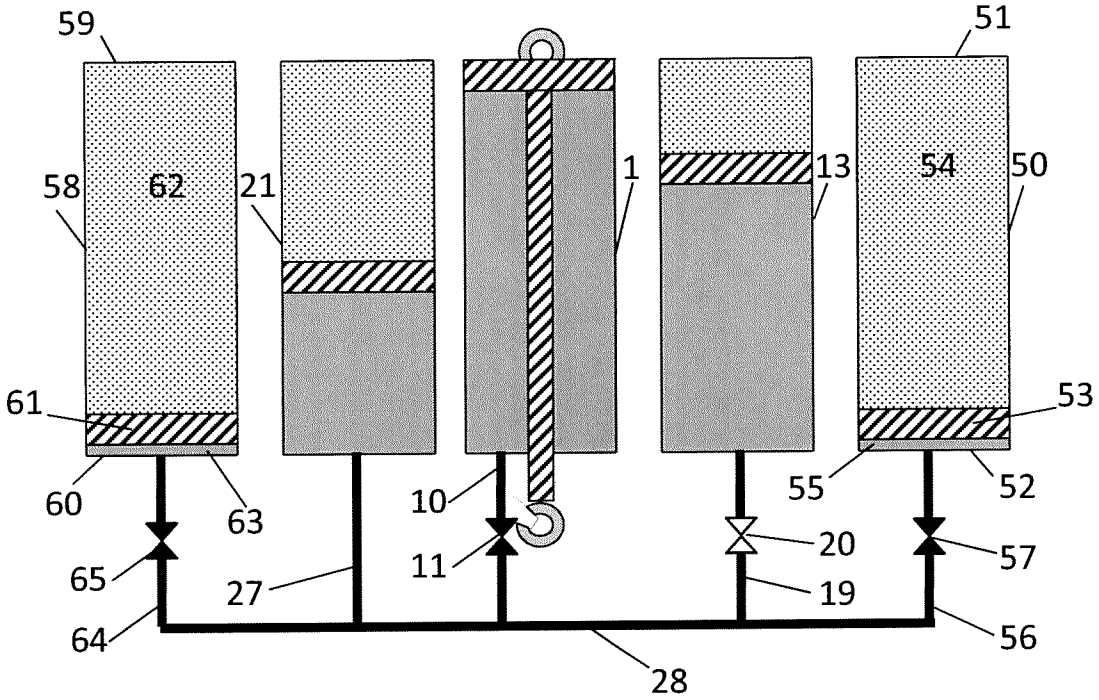
FIG. 4*a*) is a schematic view as seen from the side of another example embodiment of a heave compensator according to the first and second aspect of one or more embodiments of the present invention which includes four gas accumulators, but no gas distribution circuit.
FIG. 4*b*) is a schematic view as seen from the side of another example embodiment of a heave compensator according to the first and second aspect of one or more embodiments of the present invention which includes a gas distribution circuit.
FIG. 4*c*) is a schematic view as seen from the side of another example embodiment having four accumulators of a heave compensator according to the third and fourth aspect of one or more embodiments of the present invention by including sensor automatics for automatic regulation of the heave compensator.
Figure 4:
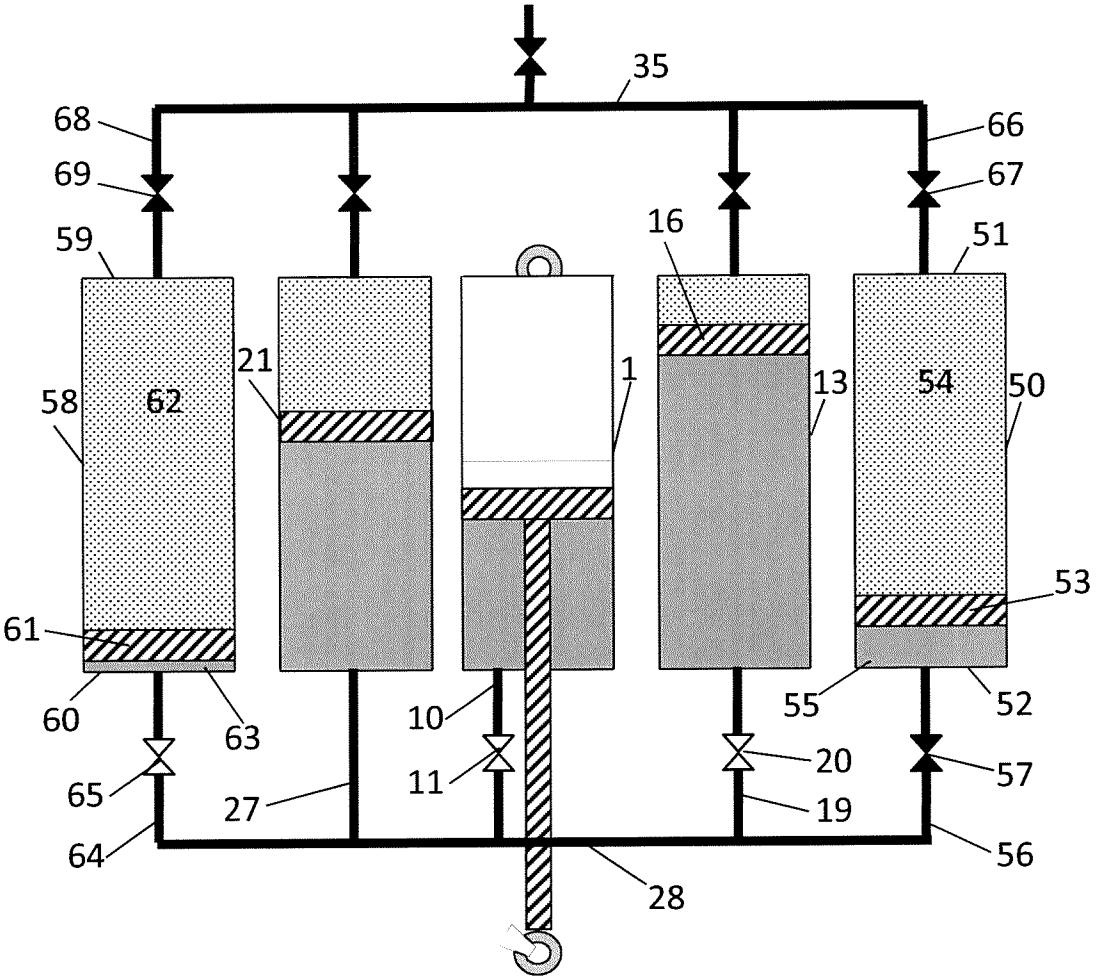
Figure 4:
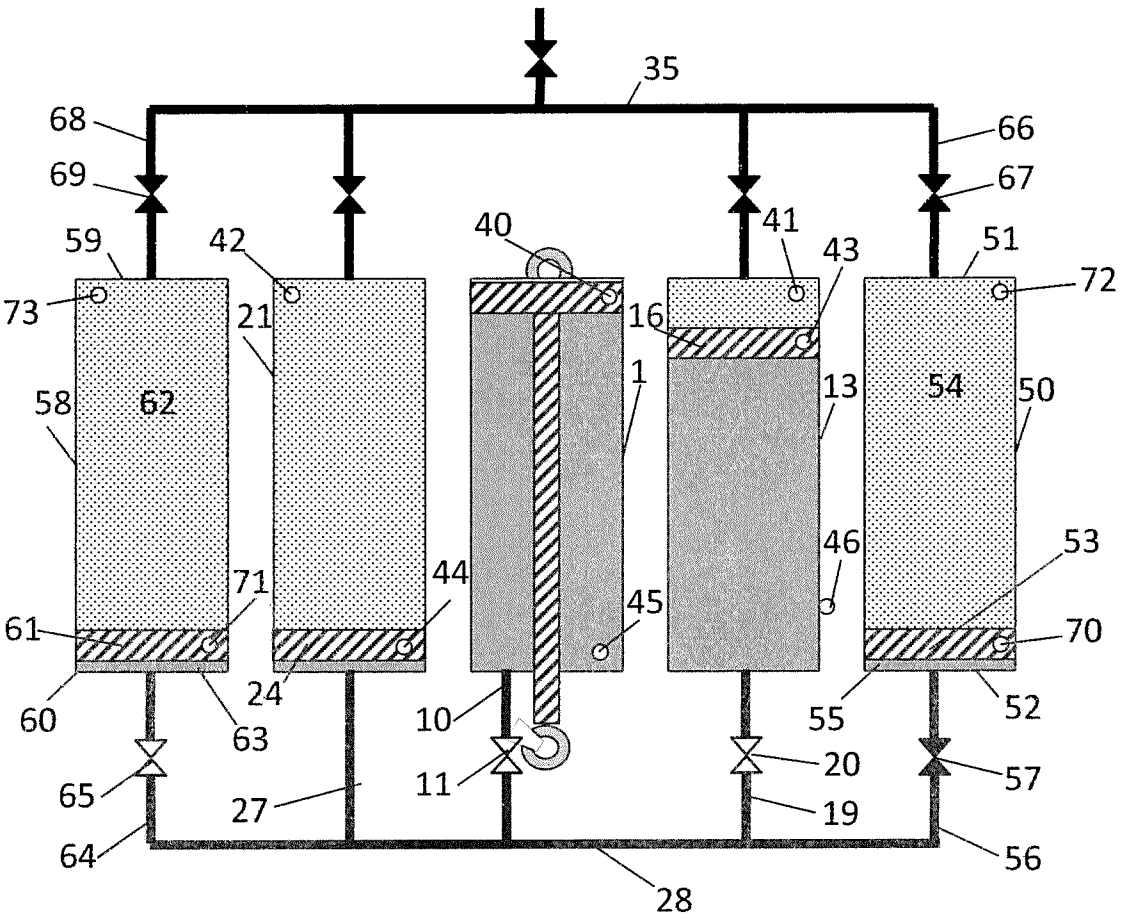
Figure 5:
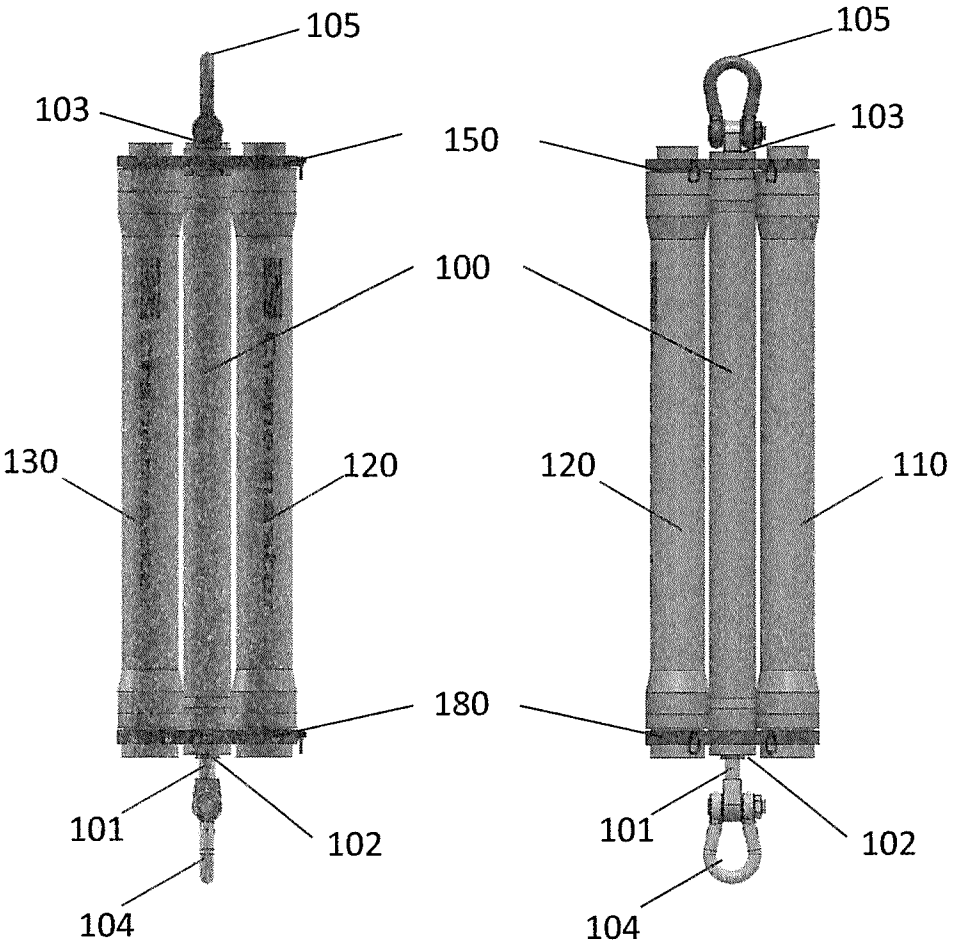
FIGS. 5*a*) to *c*) are schematic views of an example embodiment of the present invention having the gas manifold integrated in an upper assembly plate and the liquid manifold integrated in a lower assembly plate.
Figure 5:
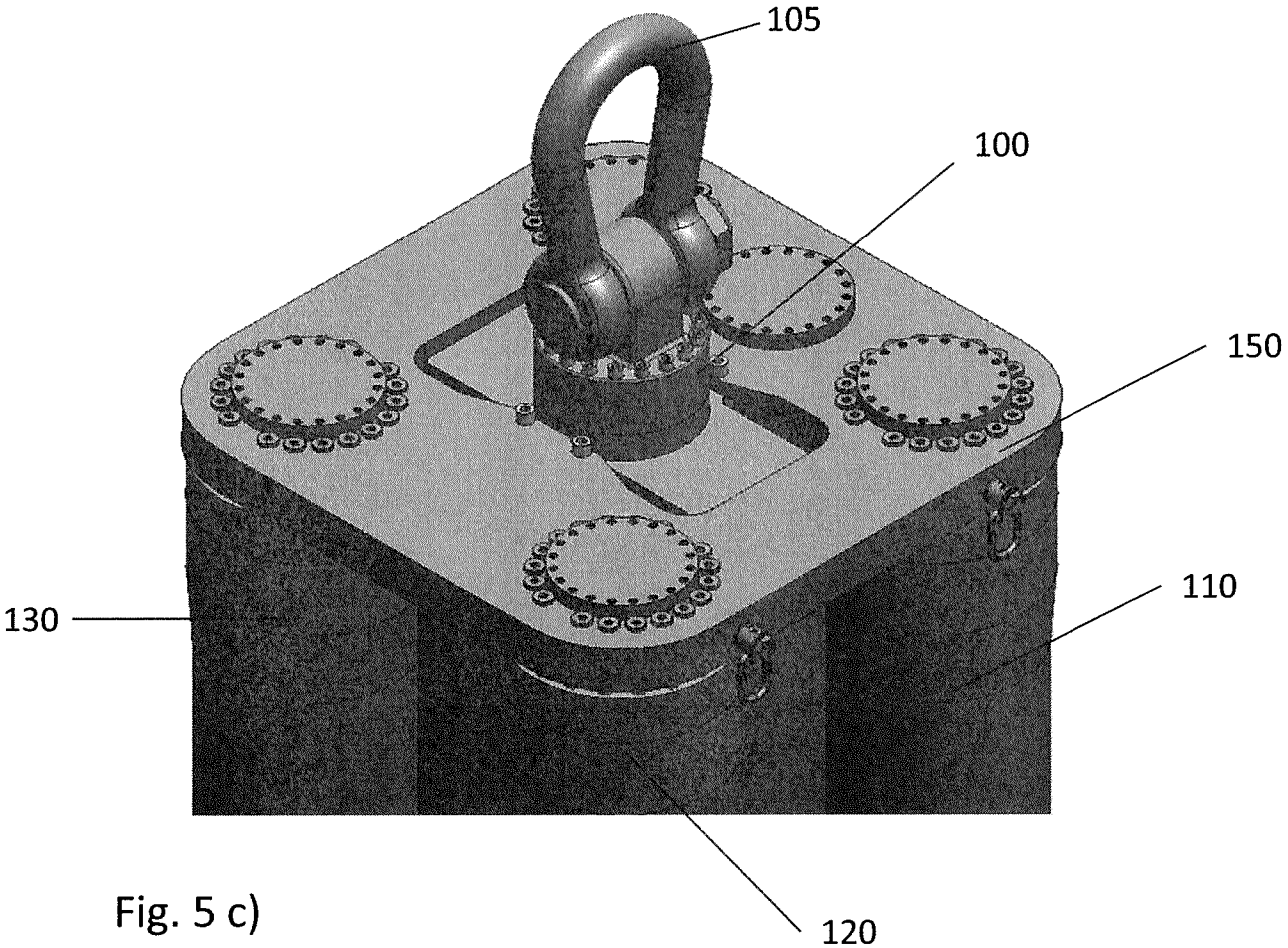

The design of an example embodiment of the heave compensator according to one or more embodiments of the present invention is illustrated in FIGS. 5*a*) to 5*c*). As seen on the figures, the example embodiment of the heave compensator has a compact construction by having a centre located main piston housing (100) surrounded by four accumulators (110), (120), (130), and (140) in a quadratic configuration by an upper (150) and a lower (180) assembly plate fastened to main piston housing and the four accumulators at their upper and lower ends.

The main piston housing (100) of the example embodiment is a vertically oriented piston cylinder having a similar configuration as the main piston housing according to any aspect of one or more embodiments of the present invention by having a slide-able piston (not shown) with a piston rod (101). The slide-able piston divides the inner space of the main piston cylinder into an upper vacuum chamber (not shown) and a lower oil-filled chamber (not shown). The piston rod (101) is shown in retracted position and sticking out of the lower end (102) of the main piston cylinder. The piston rod has in its lower end a hook (104) for releasable attachment of a load. A similar hook (105) is attached to the upper end (103) of the main piston cylinder for releasable attachment of a crane hook etc. Each of the four accumulators have a configuration equal to the accumulators according to any aspect of one or more embodiments of the present invention by having a slide-able piston (not shown) dividing the inner space of the accumulators into an upper gas filled chamber (not shown) and a lower oil filled chamber (not shown).

The compactness of the configuration of the example embodiment is further strengthened by integrating the gas distribution manifold into the upper assembly plate (150). This feature is shown schematically in FIG. 6*a*), which is a schematically exploded view showing the upper part of the four accumulators (110, 120, 130, and 140) attached in their upper ends to the assembly plate (150), see also FIG. 5*c*). The main piston cylinder is omitted in FIG. 6*a*) for the cause of clarity. The gas distribution manifold comprises three bores (151, 152, and 153) forming a conduit fluidly connecting together the four accumulators (110, 120, 130, and 140). The bores are formed by boring a linear bore from the side and into the bulk mass of the upper assembly plate (150) and positioned such that it intersects the centre axis of one accumulator and extends further until it intersects the centre axis of the adjacent accumulator at the opposite side of the upper assembly plate (150). That is, the bore (151) is located such and has a length such that it enters from a first side of the upper assembly plate (150) and passes through the centre axis of the first accumulator (110) and the centre axis of the second accumulator (120), the bore (152) is located such and has a length such that it enters from a second side perpendicular to the first side of the upper assembly plate (150) and passes through the centre axis of the third accumulator (130) and the second accumulator (120), and the bore (153) is located such and has a length such that it enters from the second side perpendicular to the first side of the upper assembly plate (150) and passes through the centre axis of the fourth accumulator (140) and the first accumulator (110). In addition there is made a bore (154) from a third side opposite the second side of the upper assembly plate (150) which extends to and fluidly connects to the bore (151). The latter bore (154) constitutes the third gas conduit and is open at its "entrance" in the sidewall of the upper assembly plate (150). The bores (151, 152, and 153) constitute the gas manifold fluidly interconnecting the first, second, third, fourth and fifth gas conduits. The bores (151, 152, and 153) are gas-tightly closed at their "entrances" into the upper assembly plate (150) by welded plugs (155, 156, and 157), respectively.

Figure 6:
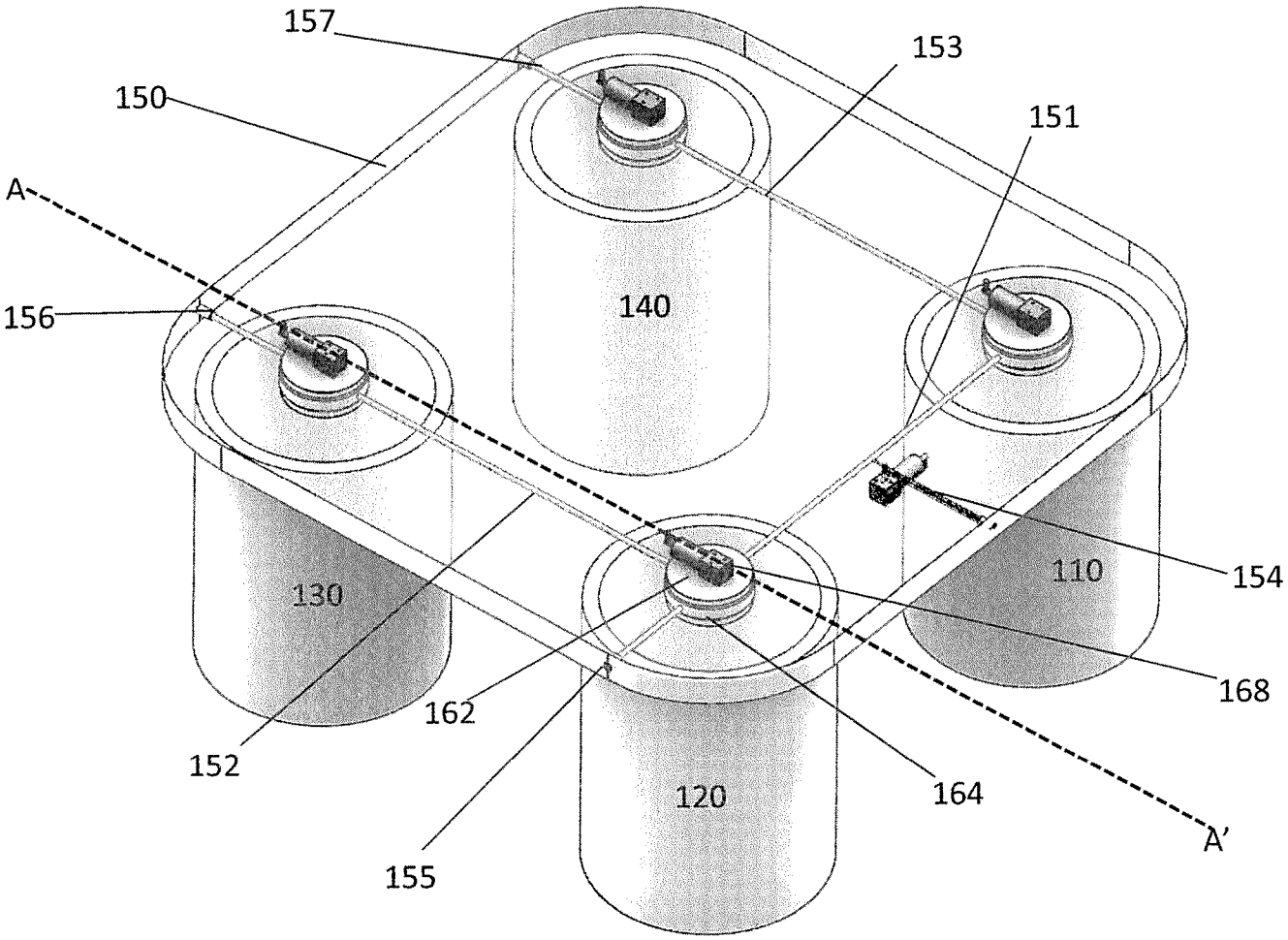
FIGS. 6*a*) and *b*) are cut views showing details of the integration of the gas manifold and the gas conduits into the upper assembly plate of the example embodiment shown in FIGS. 5*a*) to *c*).
Figure 6:
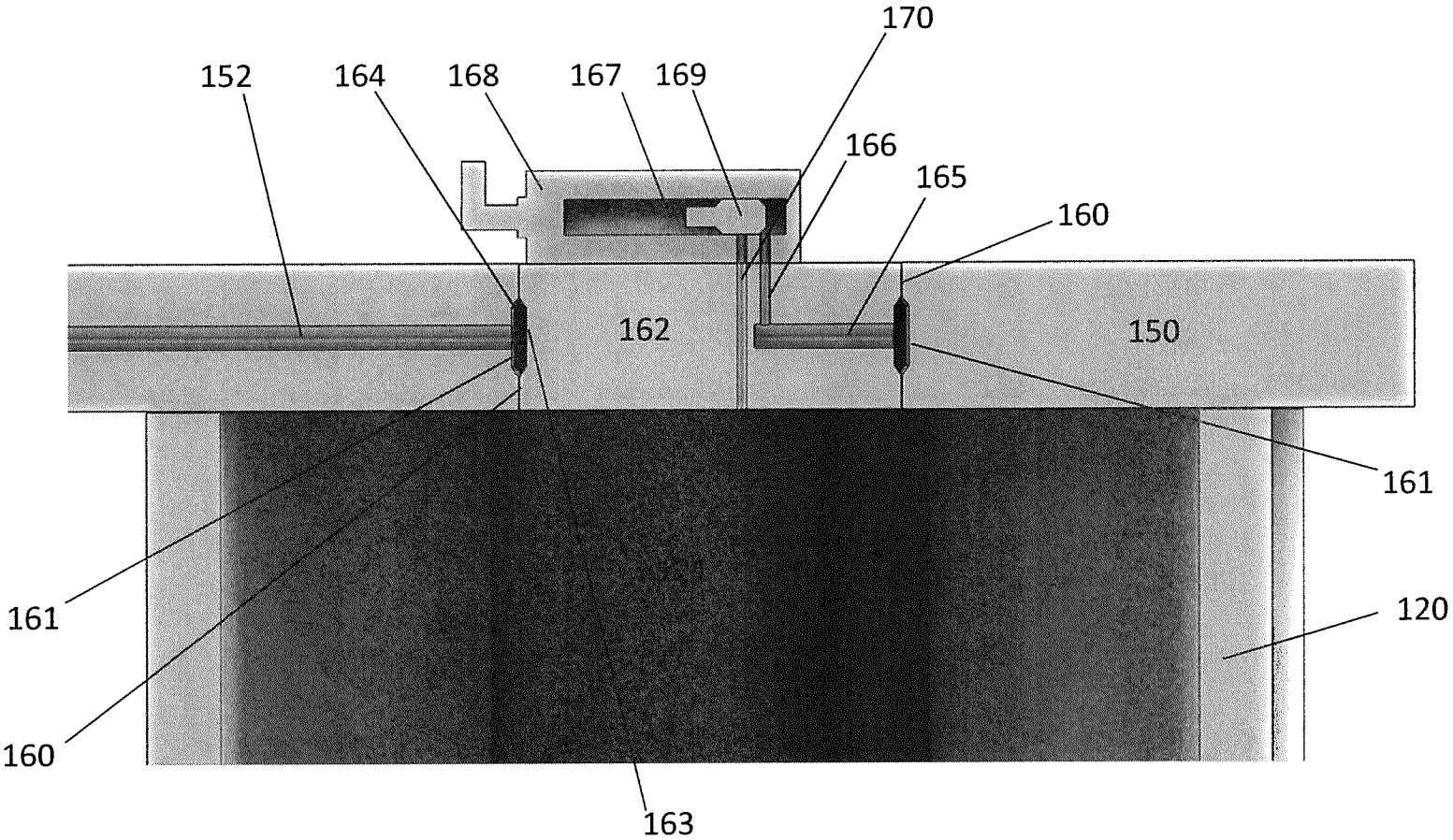

The fluidly interconnection of e.g. the second gas conduit to the gas manifold is obtained as illustrated on FIG. 6*b*), which is, as seen from the side, a vertical cross-sectional cut taken along the dotted line marked A-A' in FIG. 6*a*). Thus FIG. 6*b*) shows a cut-out section of the upper part of the second accumulator (120) and how it is integrated with the upper assembly plate (150). As seen from FIG. 6*b*), the cylinder wall of the second accumulator (120) is attached at its upper end to the assembly plate (150). The interior of the second accumulator (120) shown in FIG. 6*b*) is the upper gas-filled chamber (121) of the second accumulator. Thus the upper assembly plate (150) functions as the upper end closure of the second accumulator (and similarly for the three other accumulators).

Furthermore, as seen from FIGS. 6*a*) and 6*b*), there is made a circular throughgoing cut (160) in the upper assembly plate (150) removing a circular section of the assembly plate at the centre position of the longitudinal centre axis of the second accumulator. Likewise, similar circular throughgoing cuts are also made at the centre position of the longitudinal centre axis of the three other accumulators. Along the cut (160) in the upper assembly plate (150) there is located a centre located recess (161) running all the way around the circular cutting edge at a height corresponding to the location of the bores (151, 152, and/or 153) such that the bores becomes fluidly connected to the recesses (161) as illustrated in FIG. 6*b*) where bore (152) ends at the recess (161). The circular cut-out section of the assembly plate (150) is plugged by a circular insert (162) being fitted to gas-tightly close the opening formed by the circular through-going cut (160) in the upper assembly plate (150). The circular insert (162) has a recess (163) running along its lateral edge which corresponds to the recess (161) in the assembly plate (150), such that an annular channel (164) running around the circular insert (162) is formed inside the upper assembly plate (150) which allows gas to flow freely around the circular insert (162). As seen from FIG. 6*a*), the bores (151) and (152) are fluidly connected to each other by having one end ending in the same annular channel (164). Similarly, the other end of bore (152) is fluidly connected to the annular channel inside the assembly plate (150) formed above the third accumulator (130). The other end of bore (151) is fluidly connected to the annular channel above the first accumulator (110), and the bore 152 is fluidly connected annular channel above the first accumulator (110) and the annular channel above the fourth accumulator (140).

As seen from FIG. 6*b*) the gas in the annular channel (164) gains access to the inner space of the second accumulator (120) via the second gas conduit consisting of a horizontal bore (165) into the circular insert (162) and a first vertical bore (166) fluidly connected in one end to the horizontal bore (165) and in the other end to the inner space (167) of a solenoid valve (168), and a second vertical bore (170) fluidly connecting the inner space (167) of the solenoid valve (168) with the upper chamber (121) of the second accumulator. The solenoid valve (168) opens and closes the second gas conduit by an electromagnetically controlled magnetic body (169) able to slide from one side of the inner space (167) to the other. As seen on FIG. 6*b*), the magnetic body (169) will close the second gas conduit by blocking the openings of the vertical bores (166) and (170) when located at one side of the inner space (167). When the magnetic body is located at the other side of the inner space (167), gas is free to flow to and from the vertical bores (166) and (170) via the inner space (167) of the solenoid valve. In this manner, it is obtained a very quick opening and closing of the gas conduit at the very high pressure gradients which may arise in heave compensators utilising gas to provide the spring of the stroke. As seen on FIG. 6*a*), similar solenoid valves are applied on the gas conduits of the other three accumulators.

Figure 7:
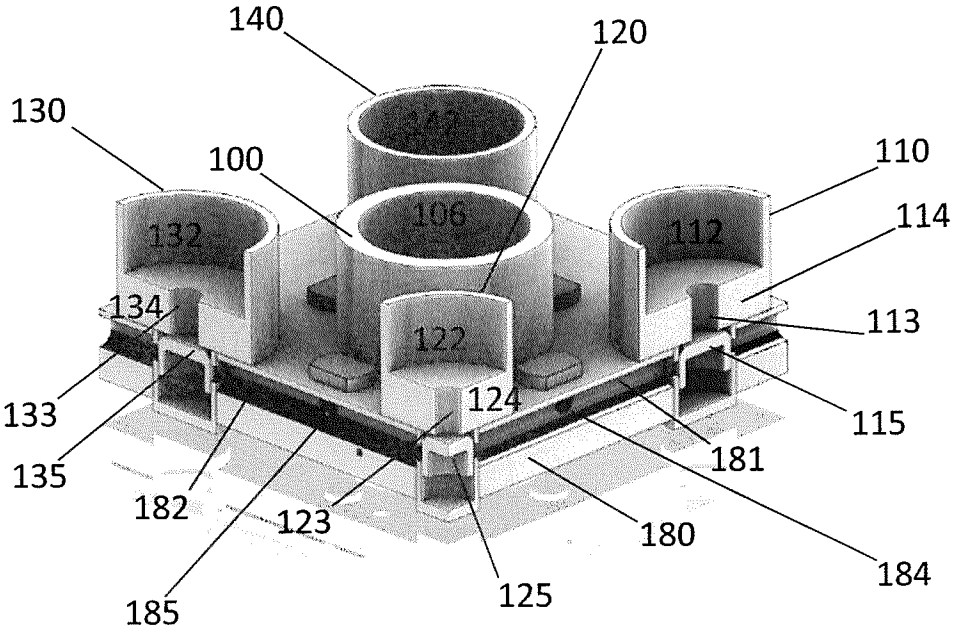
FIGS. 7*a*) and *b*) are cut views showing details of the integration of the liquid manifold and the liquid conduits into the lower assembly plate of the example embodiment shown in FIGS. 5*a*) to *c*).
Figure 7:
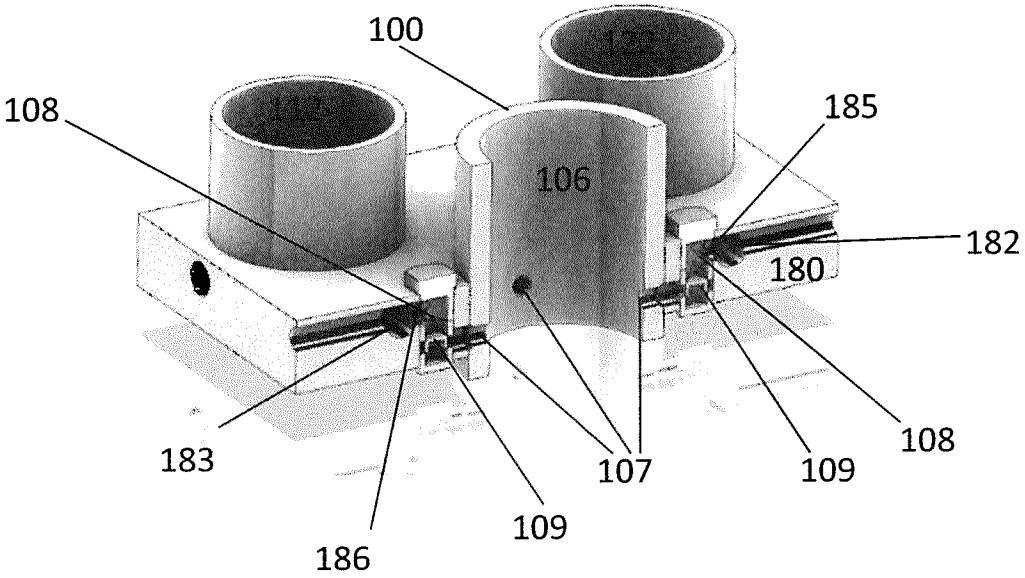

FIGS. 7*a*) and 7*b*) are cross-sectional cut out views of the lower assembly plate (180) illustrating the integration of the liquid manifold and liquid conduits at the lower end of the main piston cylinder (100) and the four accumulators (110, 120, 130, and 140).

FIG. 7*a*) illustrates two of the three bores (181, 182) which constitute the part of the liquid manifold fluidly connecting the lower liquid-filled chambers of the four accumulators. As seen on the figure, bore (181) fluidly connects the first (110) and the second (120) accumulator and the bore (182) fluidly connects the third (130) and the second (120) accumulator. A third bore (not shown) runs in parallel with the bore (182) and fluidly connects the fourth (140) and the first (110) accumulator.

The first liquid conduit (113) is formed in the bottom end (114) of the accumulator and fluidly connects the lower chamber (112) of the first accumulator (110) with the bores (181) and (183), the latter connection is not shown. At the lower part of the first liquid conduit there is located a solenoid valve (115) able to close and open the liquid conduit. FIG. 7*a*) illustrates the closed position of the valve. Similarly, the second liquid conduit (123) is formed in the lower end (124) of the second accumulator (120), fluidly connecting the lower chamber (122) of the second accumulator with bores (181) and (182) of the liquid manifold. A solenoid valve (125) is located in the lower part of the second liquid conduit (123). A similar solution, by a liquid conduit (133) in the lower end (134) and solenoid valve (135), is applied for fluidly connecting the lower chamber (132) of the third accumulator (130) with bore (182) and the lower chamber fourth accumulator (140) with bore (183), the latter connection is not shown on the figure.

The fluid connections between the bores (181, 182, and 183) of the liquid manifold and the first liquid conduit (107) in fluid communication with the lower chamber (106) of the main piston cylinder (100) are obtained by three additional bores (184, 185, and 186) oriented perpendicular to the bores (181, 182, and 183). FIG. 7*a*) shows the opening of bore (185) into bore (182) and the opening of bore (184) into bore (181).

FIG. 7*b*) shows further details of the fluid connection between the lower chamber (106) of the main piston cylinder (100) and the bores (181, 182, and 183) of the liquid manifold. This figure illustrates, as seen form the side, a cross-sectional cut taken along a vertically oriented plane dividing the lower assembly plate (180) in two equal parts. As seen on the figure, the first liquid conduit of this example embodiment consists of three equal conduits, each comprising a horizontally oriented bore (107) and a vertically oriented bore (108) having a solenoid valve (109) at the lower part of the vertically oriented bore (108) able to close of open the first liquid conduit. The use of more than one liquid conduit has the advantage of enabling a more rapid volume flow of the liquid/oil in and out of the lower chamber 106).

The invention claimed is:

1. A heave compensator intended to be suspended between a lifting device and a load to be lifted, wherein the heave compensator comprises:

a main piston housing comprising:
- an upper end having a hook for releasable attachment of the lifting device,
- a lower end having an opening adapted to provide a fluid tight enclosure around a piston rod,
- an inner space divided by a slide-able first piston into an upper chamber and a lower first liquid filled chamber, and
- the piston rod comprising a first end having a hook for releasable attachment of the load, and a second end attached to the piston, and which stretches through the liquid filled chamber and further a distance out of the opening at the lower end, a first accumulator comprising:
- an upper end,
- a lower end, and
- an inner space divided by a slide-able piston into an upper chamber filled with a gas and a lower chamber filled with a liquid, a second accumulator comprising:
- an upper end,
- a lower end, and
- an inner space divided by a slide-able piston into an upper chamber filled with a gas and a lower chamber filled with a liquid, and a liquid distribution circuit comprising:
- a liquid manifold, a first liquid conduit which in a first end is fluidly connected to the liquid filled chamber of the main piston housing and in a second opposite end is fluidly connected to the liquid manifold, a second liquid conduit which in a first end is fluidly connected to the liquid filled chamber of the first accumulator and in a second opposite end is fluidly connected to the liquid manifold, a third liquid conduit which in a first end is fluidly connected to the liquid filled chamber of the second accumulator and in a second opposite end is fluidly connected to the liquid manifold], and wherein the total volume of liquid in the heave compensator is adapted such that when the piston of the main piston housing is in an initial position, which is the closest obtainable proximity of the upper end of the cylindrical main piston housing, and the piston of the second accumulator is an initial position, which is the closest obtainable proximity of the lower end of the second accumulator, the piston of the first accumulator becomes positioned substantially in the middle of the inner space of the first accumulator, and the amount of preloaded gas in the upper chamber of the first accumulator is adapted to give a gas pressure of $p_1$ and the amount of preloaded gas in the upper chamber of the second accumulator is adapted to give a gas pressure of $p_2$, where $p_2>p_1$, when the piston of the first accumulator and the piston of the second accumulator are in initial working positions.

2. The heave compensator according to claim 1, wherein at least one of the first, second and third liquid conduits is equipped with a valve for regulating the flow of liquid through the at least one of the liquid conduits.

3. The heave compensator according to claim 2, wherein the valve being applied on the at least one of the first, second and third liquid conduits is able to regulate the flow of liquid into and out of the liquid filled chamber of the main piston housing.

4. The heave compensator according to claim 1, further comprising a gas distribution circuit comprising:

a first gas conduit fluidly connected to the gas filled upper chamber of the first accumulator, the first gas conduit has a valve for regulating a flow of gas in the first gas conduit, a second gas conduit fluidly connected to the gas filled upper chamber of the second accumulator, the second gas conduit has a valve for regulating a flow of gas in the second gas conduit, a third gas conduit fluidly connected to an environment exterior of the heave compensator, the third gas conduit has a valve for regulating a flow of gas in the third gas conduit, and a gas manifold fluidly interconnecting the first, the second, and the third gas conduits.

5. The heave compensator according to claim 4, further comprising:

a pressure and temperature sensor located in the gas-filled upper chamber of the first accumulator, a pressure and temperature sensor located in the gas-filled upper chamber of the second accumulator, a position sensor located on the piston of the main piston housing, a position sensor located on the piston of the first accumulator, a position sensor located on the piston of the second accumulator, a pressure and temperature sensor located in the lower chamber of the main piston housing, a pressure and temperature sensor located on the outside of the heave compensator for measuring the pressure and temperature of the environment exterior of the heave compensator, and a control unit having computer software which enables determining the equilibrium position of the piston of the main piston housing as from the sensor data, and then determine whether to vent off an amount of gas from the first accumulator or to extract an amount of gas from the second accumulator into the first accumulator as described above, and which enables engaging and controlling actuators of the valves of the gas distribution circuit to obtain the intended venting off or injection of gas out off/into the first accumulator.

6. The heave compensator according to claim 1, wherein the total amount of liquid in the heave compensator is adapted, when the piston of the main piston housing and the piston of the second accumulator are in initial positions, to make the piston of the first accumulator to be in an initial position in the range of from ¼ to ¾, where the position is defined to be zero when the piston is at the upper end of the inner space of the main piston housing or first or second accumulator, respectively, and increasing linearly towards the lower end where the position per definition is set to 1.

7. The heave compensator according to claim 1, wherein:

a pre-loaded amount, $n_1$, of gas in the upper chamber of the first gas accumulator is determined by applying a gas equation of state with a gas pressure of: $p_1=(DAF(t)\cdot m_{load}\cdot g-p_{atm}\cdot A_m)/A_1$ and a gas volume $V_1$ equal to the volume of the upper chamber of the first accumulator when the piston is in an initial working position, where:

$A_1$ is the upper surface area of the piston of the first accumulator, $m_{load}$ is the mass of the load, g is the gravity of Earth, $p_{atm}$ is the atmospheric pressure, and $A_m$ is the surface area of the upper side of the piston of the main piston housing, and a pre-loaded amount, $n_2$, of gas in the upper chamber of the second gas accumulator is determined by applying a gas equation of state with a gas pressure of: $p_2=\gamma_1 p_1$, where $\gamma_1$ is a constant in the range of [1.1, $0.95\cdot DAF_{max}$], [1.15, $0.90\cdot DAF_{max}$], [1.20, $0.85\cdot DAF_{max}$], or $(DAF_{stat}+DAF_{max})/2$, and where $DAF_{max}\geq 1.5$.

8. The heave compensator according to claim 1, further comprising:

a third accumulator comprising:

an upper end, a lower end, and an inner space divided by a slide-able piston into an upper chamber filled with a gas and a lower chamber filled with a liquid, a fourth accumulator comprising:

an upper end, a lower end, and an inner space divided by a slide-able piston into an upper chamber filled with a gas and a lower chamber filled with a liquid, and where the liquid distribution circuit further comprises:

a fourth liquid conduit having a valve for regulating the flow of liquid in the liquid conduit, and which in a first end is fluidly connected to the liquid filled chamber and in a second opposite end is fluidly connected to the liquid manifold, and a fifth liquid conduit having a valve for regulating the flow of liquid in the liquid conduit, and which in a first end is fluidly connected to the liquid filled chamber and in a second opposite end is fluidly connected to the liquid manifold, and wherein the total volume of liquid in the heave compensator is adapted such that when:

the piston of the main piston housing is in its initial position, which is 0, the piston of the first accumulator becomes positioned in its initial position, which is from 0 to ¾, the piston of the second accumulator is in its initial position, which is 1, where the position is defined to be zero when the piston is at the upper end of the inner space of the main piston housing or first or second accumulator, respectively, and increasing linearly towards the lower end where the position per definition is set to 1, and wherein the amount of gas in the upper chamber of the first accumulator is adapted to give a gas pressure of $p_1$ and the amount of gas in the upper chamber of the second accumulator is adapted to give a gas pressure of $p_2$, when the piston of the first accumulator, the piston of the second accumulator are in initial working positions, and where $p_2>p_1$.

9. The heave compensator according to claim 8, further comprising a gas distribution circuit comprising:

a fourth gas conduit having a valve for regulating a flow of gas in the fourth gas conduit, and which in a first end is fluidly connected to the gas filled upper chamber of the third accumulator and in a second opposite end is fluidly connected to the gas manifold, and a fifth gas conduit having a valve for regulating a flow of gas in the fifth gas conduit, and which in a first end is fluidly connected to the gas filled upper chamber of the fourth accumulator and in a second opposite end is fluidly connected to the gas manifold.

10. The heave compensator according to claim 8, further comprising:

a pressure and temperature sensor located in the gas-filled upper chamber of the third accumulator, a pressure and temperature sensor located in the gas-filled upper chamber of the fourth accumulator, a position sensor located on the piston of the third, and a position sensor located on the piston of the fourth accumulator.

11. The heave compensator according to claim 8, wherein:

the initial working position of the piston of the first accumulator is substantially ⅓, the initial working position of piston of the second accumulator is substantially 1, and the initial working position of piston of the third accumulator is substantially 1, where the position is defined to be zero when the piston is at the upper end of the inner space of the main piston housing or first or second accumulator, respectively, and increasing linearly towards the lower end where the position per definition is set to 1, and a pre-loaded amount, $n_1$, of gas in the upper chamber of the first gas accumulator is determined by using a gas equation of state with a gas volume $V_1$ equal to the volume of the upper chamber of the first accumulator when piston is in an initial working position, and a gas pressure of:

$$p_1=(DAF_{stat}\cdot m_{load}\cdot g-p_{atm}\cdot A_m)/A_1,$$ where:

$m_{load}$ is the mass of the load, g is the gravity of Earth, $p_{atm}$ is the atmospheric pressure, $A_m$ is the surface area of the upper side of piston of the main piston housing, and $A_1$ is the surface area of the upper side of piston of the first accumulator, a pre-loaded amount, $n_2$, of gas in the upper chamber of the second gas accumulator is determined by applying a gas equation of state with a gas volume $V_2$ equal to the volume of the upper chamber of the second accumulator when piston is in an initial working position, and a gas pressure of: $p_2=\gamma_2\cdot p_1$, where $\gamma_2$ is a real number constant having a value in the range of [1.2, $0.97\cdot DAF_{max}$], preferably of [1.3, $0.95\cdot DAF_{max}$], and most preferably $(DAF_{stat}+DAF_{max})/1.9$, and where $DAF_{max}\geq 1.5$, and the amount, $n_3$, of gas being pre-loaded into chamber of the third gas accumulator is determined by applying a gas equation of state with a gas volume $V_3$ equal to the volume of the upper chamber when piston is in an initial working position, and a gas pressure of: $p_3=\gamma_3\cdot p_1$, where $\gamma_3$ is a real number constant having a value in the range of [1.3, $0.98\cdot DAF_{max}$], preferably of [1.4, $0.96\cdot DAF_{max}$] and most preferably of $(DAF_{stat}+DAF_{max})/1.8$, and where $DAF_{max}\geq 1.5$ and $p_3>p_2>p_1$.

12. The heave compensator according claim 8, where:

the main piston housing is a cylindrical piston cylinder having a slide-able piston dividing an inner space thereof into an upper vacuum chamber and a lower oil-filled chamber, and where the piston rod has a hook for releasable attachment of a load and the upper end of the main piston cylinder has a hook for releasable attachment of a crane/lifting device, the cylindrical piston cylinder is located in the centre of the first, second, third, and fourth accumulators being arranged in a quadratic configuration of one accumulator in each corner, the cylindrical piston cylinder and the first, second, third, and fourth accumulators are arranged in parallel and mechanically attached in an intended configuration by an upper and a lower assembly plate located at the upper and lower ends of the main piston cylinder and accumulators, respectively, and wherein:

the gas distribution manifold is integrated into the upper assembly plate by a set of linear bores in the assembly plate, where:

bore is made from a side of the upper assembly plate and extends inward in the upper assembly plate until passing through the centre axis of the first accumulator and the centre axis of the second accumulator, where entrance of the bore into the upper assembly plate is gas tight blocked by a welded plug, and where the bore is fluidly connected to the upper chamber of the first accumulator by the first gas conduit and the upper chamber of the second accumulator by the second gas conduit, the bore is made from a side of the upper assembly plate and extends inward in the upper assembly plate until passing through the centre axis of the third accumulator and the second accumulator, where entrance of the bore into the upper assembly plate is gas tight blocked by a welded plug, and where the bore is fluidly connected to the upper chamber of the third accumulator by the third gas conduit and the upper chamber of the second accumulator by the second gas conduit, and the bore enters from a side of the upper assembly plate and extends inward in the upper assembly plate until passing through the centre axis of the fourth accumulator and the first accumulator, where the entrance of the bore into the upper assembly plate is gas tight blocked by a welded plug, and where the bore is fluidly connected to the upper chamber of the fourth accumulator by the fourth gas conduit and the upper chamber of the first accumulator by the first gas conduit, and the liquid distribution manifold is integrated into the lower assembly plate by a set of linear bores in the lower assembly plate, where:

bore is made from a side of the lower assembly plate and extends inward in the lower assembly plate until passing through the centre axis of the first accumulator and the centre axis of the second accumulator, where the entrance of the bore into the lower assembly plate is fluid tight blocked by a welded plug, and is fluidly connected to the second liquid conduit of the first accumulator and the third liquid conduit of the second accumulator, bore enters from a side of the lower assembly plate and extends inward in the lower assembly plate until passing through the centre axis of the third accumulator and the centre axis of the second accumulator, where:

the entrance of the bore into the lower assembly plate is fluid tight blocked by a welded plug, and is fluidly connected to the fourth liquid conduit of the third accumulator and the third liquid conduit of the second accumulator, bore enters from a side of the lower assembly plate and extends inward in the lower assembly plate until passing through the centre axis of the fourth accumulator and the centre axis of the first accumulator, where:

the entrance of the bore into the lower assembly plate is fluid tight blocked by a welded plug, and is fluidly connected to the fifth liquid conduit of the fourth accumulator and the second liquid conduit of the first accumulator, bore is fluidly connected to the first liquid conduit and bore, bore is fluidly connected to the first liquid conduit and bore, and bore is fluidly connected to the first liquid conduit and bore.

13. The heave compensator according to claim 12, wherein:

the upper assembly plate has a circular throughgoing cut forming a circular opening centred at the longitudinal centre axis at each of the four accumulators, where each of the four cuts has a recess in the assembly plate running all the way around the circular cutting edge at a height corresponding to the location of the bores, a circular insert being fitted to gas-tightly close the opening formed by the circular throughgoing cut is inserted in each of the circular openings, and where each of the circular inserts has a recess running along a lateral edge which corresponds to the recess in the assembly plate such that an annular channel running around the circular insert is formed inside the upper assembly plate, and wherein each of the first, second, fourth, and fifth gas conduit is integrated in a circular insert by comprising a horizontal bore into the circular insert, a first vertical bore fluidly connected in one end to the horizontal bore and in the other end to an inner space of a solenoid valve, and a second vertical bore fluidly connecting the inner space of the solenoid valve with the upper chamber of the accumulator being located below the circular insert.

14. The heave compensator according to claim 12, wherein:

the second liquid conduit is formed by a vertical bore in the bottom of the first accumulator fluidly connecting the lower chamber of the accumulator with bores, and which has a solenoid valve located in the conduit able to close and open the liquid conduit, the third liquid conduit is formed by a vertical bore in the bottom of the second accumulator fluidly connecting the lower chamber of the accumulator with bores, and which has a solenoid valve located in the conduit able to close and open the liquid conduit, the fourth liquid conduit is formed by a vertical bore in the lower end of the third accumulator fluidly connecting the lower chamber of the accumulator with bore, and which has a solenoid valve located in the conduit able to close and open the liquid conduit, the fifth liquid conduit is formed by a vertical bore in the bottom of the fourth accumulator fluidly connecting the lower chamber of the accumulator with bore, and which has a solenoid valve located in the conduit able to close and open the liquid conduit, and the first liquid conduit consists of three equal conduits, each comprising a horizontally oriented bore fluidly connected to the lower chamber of the main piston cylinder and a vertically oriented bore fluidly connected to one of bores, respectively, and where each of the vertically oriented bores has a solenoid valve able to close and open the conduit.

15. The heave compensator according to claim 7, wherein the gas equation of state being applied to determine the gas amounts to be preloaded into the first and the second accumulator is either; the ideal gas law, Van der Waal's equation for real gases, or the Peng-Robinson gas equation of state.

16. A method for reducing the risk of snap-loads during the splash-zone phase when a load is deployed into the sea/water from a floating deployment vessel having a lifting device, wherein the method comprises the following steps:

A) applying a heave compensator according to claim 4,

B) preparing the heave compensator before commencing the lifting operation by:

placing the piston of the second accumulator in a lower position in the closest possible proximity to the second end, and loading the upper chamber of the second accumulator with an amount of a gas sufficient to obtain gas pressure $p_2$, and loading the upper chamber of the first accumulator with an amount of a gas sufficient to obtain gas pressure $p_1$, wherein $p_1<p_2$, and releasable attaching a lifting device to the attachment means and releasable attaching the load to the attachment means, C) executing the dry-zone phase of the lifting operation by lifting of the load from the basement of the deployment vessel by the lifting device, G) executing the splash-zone phase of the lifting operation by lowering the load to make contact with the water/sea by use of the lifting device.

17. The method according to claim 16, wherein:

step A) applies a heave compensator wherein at least one of the first, second and third liquid conduits is equipped with a valve for regulating the flow of liquid through the liquid conduits and which at least comprises a valve on the first liquid conduit, step B) further comprises opening valve of the first liquid conduit, and if present, opening valve the second liquid conduit, after loading the upper chamber of the second accumulator with gas and before loading the upper chamber of the first accumulator with gas, and wherein the method further comprises the following step to be performed after step C) and before step G):

D) if valve of the first liquid conduit is closed, open valve after the load is lifted to a safe distance above a deployment vessel thereof in order to engage the heave compensation effect of the heave compensator.

18. The method according to claim 17, further comprising the following process step which is to be applied after step D) and before step G):

E) determining the equilibrium position of piston of the main piston housing by:

1) measuring the position of piston of the main piston housing by the position sensor and employing the measured positions to determine the measured equilibrium position, $S_k$, of the piston, 2) comparing the measured equilibrium position, $S_k$, with a predetermined intended equilibrium position $S_0$, of the piston, and 3) determine the difference $|S_0-S_k|$, F) executing the following sub-process steps:

1) if $|S_0-S_k i<K_1$, where $K_1$ is a predetermined adjustment threshold criteria, then abort the dry phase adjustment of the equilibrium position and go directly to step G) below, or else continue to sub-step 2) below:

2) if $S_0-S_k>0$, then:

i) open valve on the first gas conduit and valve on the third gas conduit, ii) continuously measuring the position of piston of the main piston housing by the position sensor and employing the measured positions to continuously determine the measured equilibrium position, $S_k$, of the piston, and then continuously determining the difference $|S_0-S_k|$ and comparing the continuously determined difference with the predetermined adjustment threshold criteria, and if $|S_0-S_k|<K_1$, close valve on the first gas conduit and valve on the third gas conduit, and go directly to step G), or:

3) if $S_0-S_k<0$, then:

j) open valve on the first gas conduit and valve on the second gas conduit, jj) continuously measuring the position of piston of the main piston housing by the position sensor and employing the measured positions to continuously determine the measured equilibrium position, $S_k$, of the piston, and then continuously determining the difference $|S_0-S_k|$ and comparing the continuously determined difference with the predetermined adjustment threshold criteria, and if $|S_0-S_k|<K_1$, close valve on the first gas conduit and valve on the second gas conduit, and go directly to step G).

19. The method according to claim 18, further comprising the following process step to be performed after step G):

H) equalising the pressures of the first and second gas accumulator by opening valve on the first gas conduit and valve on the second gas conduit.

20. The method according to claim 19, further comprising the following process steps to be performed after step H):

I) determining the equilibrium position of piston of the main piston housing by:

1) measuring the position of piston of the main piston housing by the position sensor and employing the measured positions to determine the measured equilibrium position, $S_k$, of the piston, 2) comparing the measured equilibrium position, $S_k$, with a predetermined intended equilibrium position $S_0$, of the piston, and 3) determine the difference $|S_0-S_k|$, and J) executing the following sub-process steps:

1) if $|S_0-S_k|<K_1$, where $K_1$ is a predetermined adjustment threshold criteria, then stop the wet phase adjustment of the equilibrium position, or else continue to sub-step 2) below:

2) i) open valve on the third gas conduit, and ii) continuously measuring the position of piston of the main piston housing by the position sensor and employing the measured positions to continuously determine the measured equilibrium position, $S_k$, of the piston, and then continuously determining the difference $|S_0-S_k|$ and comparing the continuously determined difference with the predetermined adjustment threshold criteria, and if $|S_0-S_k|<K_1$, close valve on the third gas conduit, and stop the wet phase adjustment of the equilibrium position of piston of the main piston housing.

21. The method according to claim 16, wherein the adjustment threshold criteria $K_1$ is less than 5% of the intended equilibrium position $S_0$.

* * * * *